US008006857B2

(12) United States Patent
Lin

(10) Patent No.: US 8,006,857 B2
(45) Date of Patent: Aug. 30, 2011

(54) COVER ASSEMBLY FOR TRASH BIN

(75) Inventor: Tsong-Yow Lin, Taichung Hsien (TW)

(73) Assignee: Chen Sung Industrial Co., Ltd., Yung Ho Village (TW)

( * ) Notice: Subject to any disclaimer, the term of this patent is extended or adjusted under 35 U.S.C. 154(b) by 973 days.

(21) Appl. No.: 11/868,565

(22) Filed: Oct. 8, 2007

(65) Prior Publication Data

US 2008/0179327 A1 Jul. 31, 2008

(30) Foreign Application Priority Data

Jan. 26, 2007 (TW) ..... 96103100 A

(51) Int. Cl.
*B65D 43/16* (2006.01)
*E05F 1/08* (2006.01)

(52) U.S. Cl. ..... 220/254.5; 220/830; 220/908; 16/303; 16/330

(58) Field of Classification Search ..... 220/254.5, 220/830, 908; 16/303, 330; 379/433.13
See application file for complete search history.

(56) References Cited

U.S. PATENT DOCUMENTS

| | | | | |
|---|---|---|---|---|
| 5,205,015 | A * | 4/1993 | Huang | 16/50 |
| 6,857,538 | B2 | 2/2005 | Lin | 220/830 |
| 2003/0201268 | A1 | 10/2003 | Lin | 220/263 |

OTHER PUBLICATIONS

Taiwanese Patent Publication No. TW I252835, Apr. 11, 2006, 7 pages.
Taiwanese Utility Model Publication No. TW M265345 A1, May 21, 2005, 6 pages.
Japanese Patent Publication No. JP10-311360 A, Nov. 24, 1998, 5 pages.
Japanese Patent Publication No. JP2000-93350 A, Apr. 4, 2000, 7 pages.
PCT Publication No. WO 2005/080232 A1, Sep. 1, 2005, 51 pages.
Chinese Patent Publication No. CN 1296259 C, Jan. 24, 2007, 15 pages.

* cited by examiner

*Primary Examiner* — Anthony Stashick
*Assistant Examiner* — James N Smalley
(74) *Attorney, Agent, or Firm* — Alan Kamrath; Kamrath & Associates PA

(57) ABSTRACT

A cover assembly for a trash bin includes a cover, a support ring, a pivoting device coupling to the cover and the support ring and a buffer device connecting to the pivoting device. The pivoting device provides an upward force to the cover, and the buffer device cushions the upward force from the pivoting device. The buffer device and the pivoting device allow the cover assembly to be lifted slowly and prevent a loud noise while lifting the cover quickly and while the cover bumps the trash bin.

11 Claims, 24 Drawing Sheets

COVER ASSEMBLY FOR TRASH BIN

BACKGROUND OF THE INVENTION

The present invention relates to a cover assembly for a trash bin and, more particularly, to a cover assembly for trash bins with a buffer device and a pivoting device.

A trash bin is a requirement of life and, in substance, is made from plastic or metal according to where the trash bin is used. At a hotel or such places, a metal trash bin is usually a better choice than a plastic trash bin. Furthermore, the ways to open the cover of the trash bin usually include: to step on a pedal for driving a rod, which connects the pedal and the cover, to lift the cover and to press the cover for providing an exterior force to release a pressed elastic element, which pivotally connects the cover and the bin, so that the released elastic element would allow the cover being lifted upward automatically.

Referring to U.S. Pat. No. 6,857,538, a garbage bin includes a cover 20 pivotally connecting to a ring 10 via two slow pivot elements 30 disposed in a semi-sleeve 24 of the cover 20. Each of the slow pivot elements 30 further includes an interior tube 31, an exterior tube 32 receiving the interior tube 31 therein and a spring 33 disposed in the interior tube 31 and abutting with the interior surface of the exterior tube 32 opposite to the interior tube 31.

While the cover 20 is closed, each of the springs 33 is pressed, and the slow pivot elements 30 stay in a first position. However, when a user presses the cover 20 to make the cover 20 open, each of the springs 33 is released, and the slow pivot elements 30 would be pushed toward each other and in a second position. Thus, the elastically of the springs 33 would allow the cover 20 to open.

At the same time, since the material of the trash bin is metal and while the springs 33 provide a force to open the cover 20, the cover 20 would bump the bin and make a loud noise.

It is, therefore, a need for a cover assembly for a trash bin that allows quiet operation even when opening the cover quickly.

SUMMARY OF THE INVENTION

The present invention solves this need and other problems in the field of cover assemblies with a buffer device for trash bins by providing, in a preferred form, a cover assembly for a trash bin, which is mounted on a bin of the trash bin and includes a support ring disposed on the top of the bin of the trash bin, a cover mounted on the support ring, a pivoting device pivotally connected to the support ring and the cover and allowing the cover to be lifted upward, and a buffer device coupling to the pivoting device.

While the cover is closed, the pivoting device allows the buffer device to be in a first position. However, when the cover is pressed for opening, the pivoting device is released and provides a force to lift the cover. Simultaneously, a part of the force of the pivoting device would be cushioned via the buffer device, and the buffer device is adapted to slow down the speed of lifting the cover. Thus, the operation of lifting the cover would be quieter.

Other advantages, objectives and features of the present invention will become apparent from the following description referring to the attached drawings.

DETAILED DESCRIPTION OF THE PREFERRED EMBODIMENT

Figure 1:
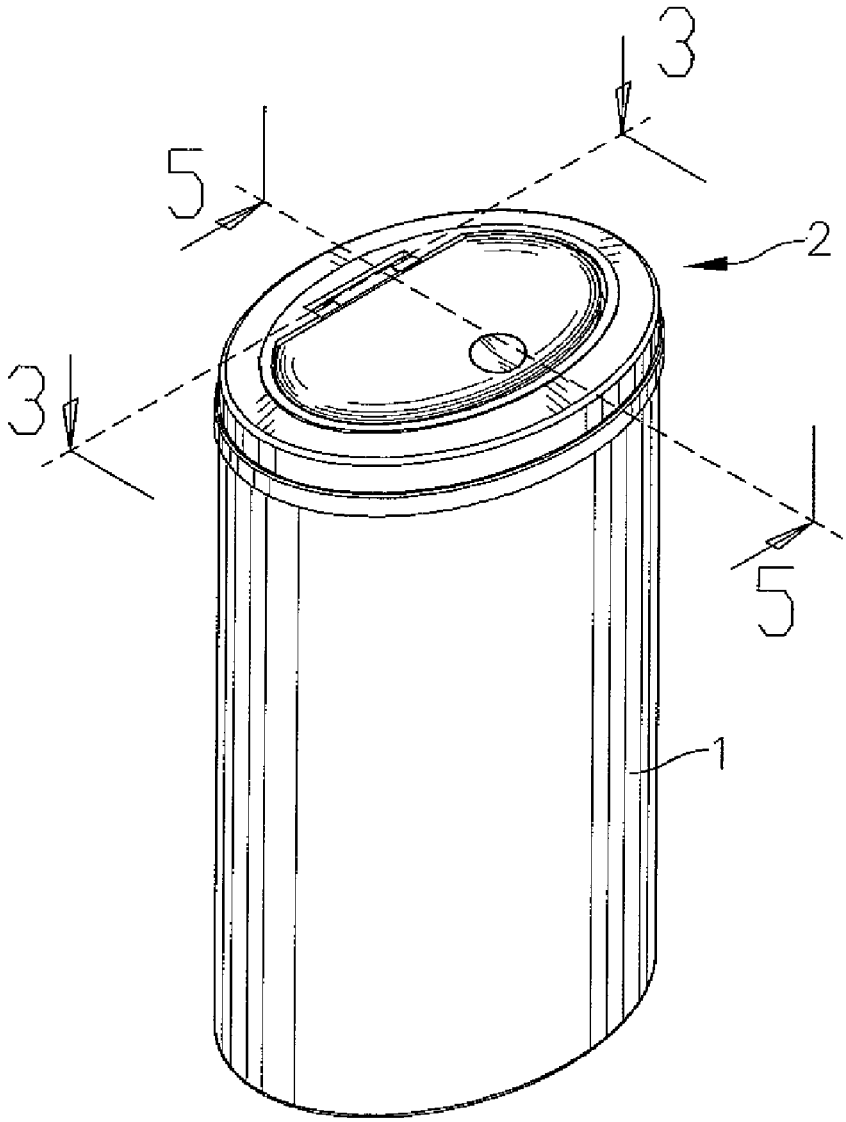
FIG. 1 shows a perspective view of a trash bin according to a first embodiment of the present invention.
Figure 2:
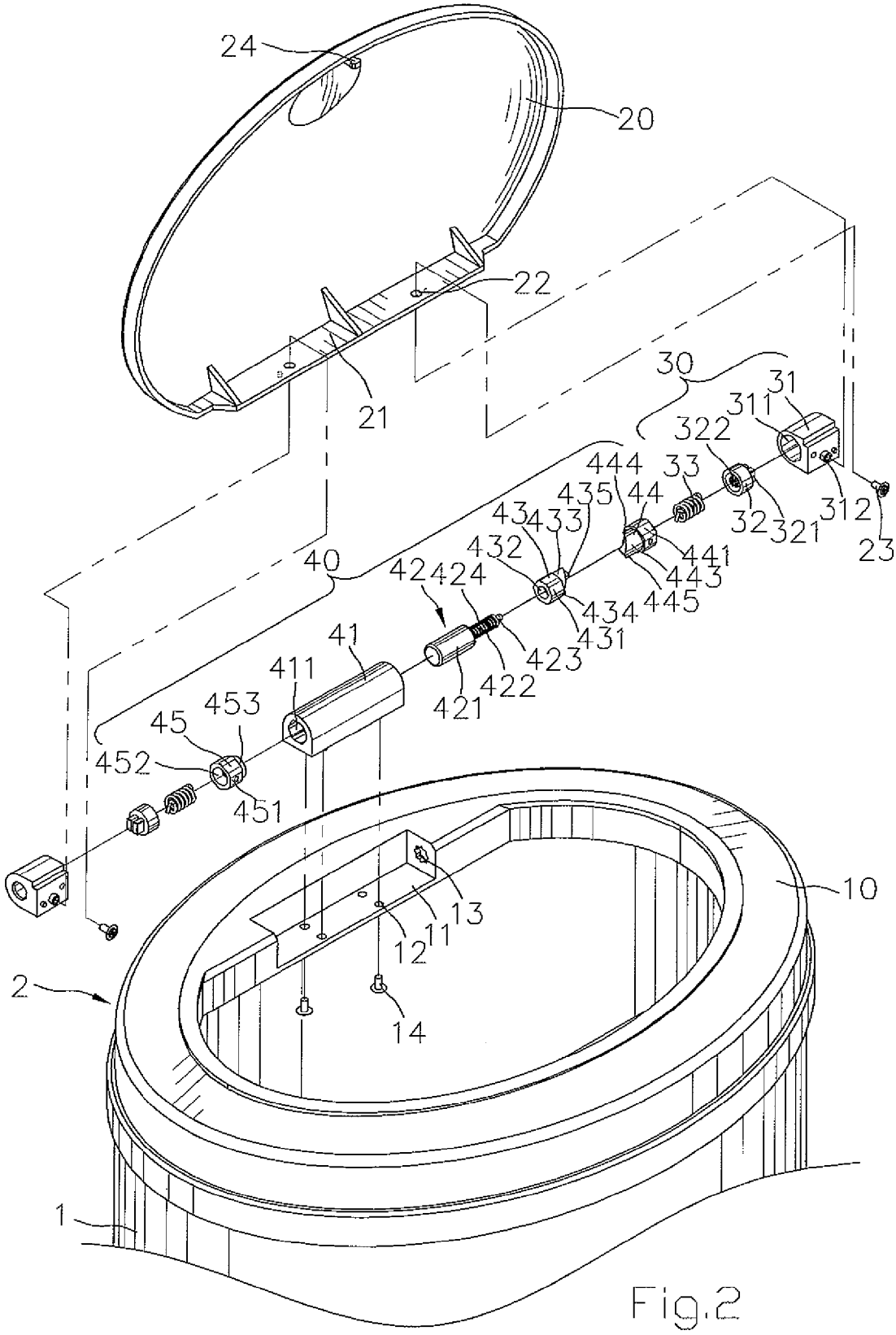
FIG. 2 shows an exploded view of the trash bin according to the first embodiment of the present invention.
Figure 3:
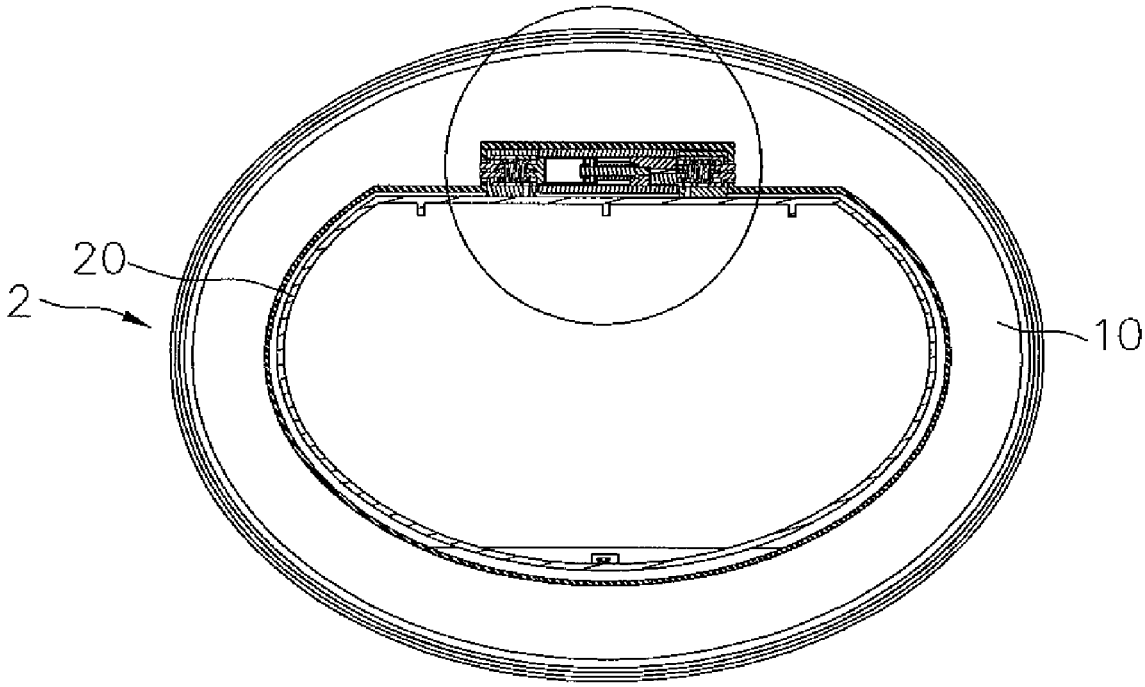
FIG. 3 is a cross-sectional view taken along line 3-3 in FIG. 1, illustrating a cover mounted on a support ring.
Figure 4:
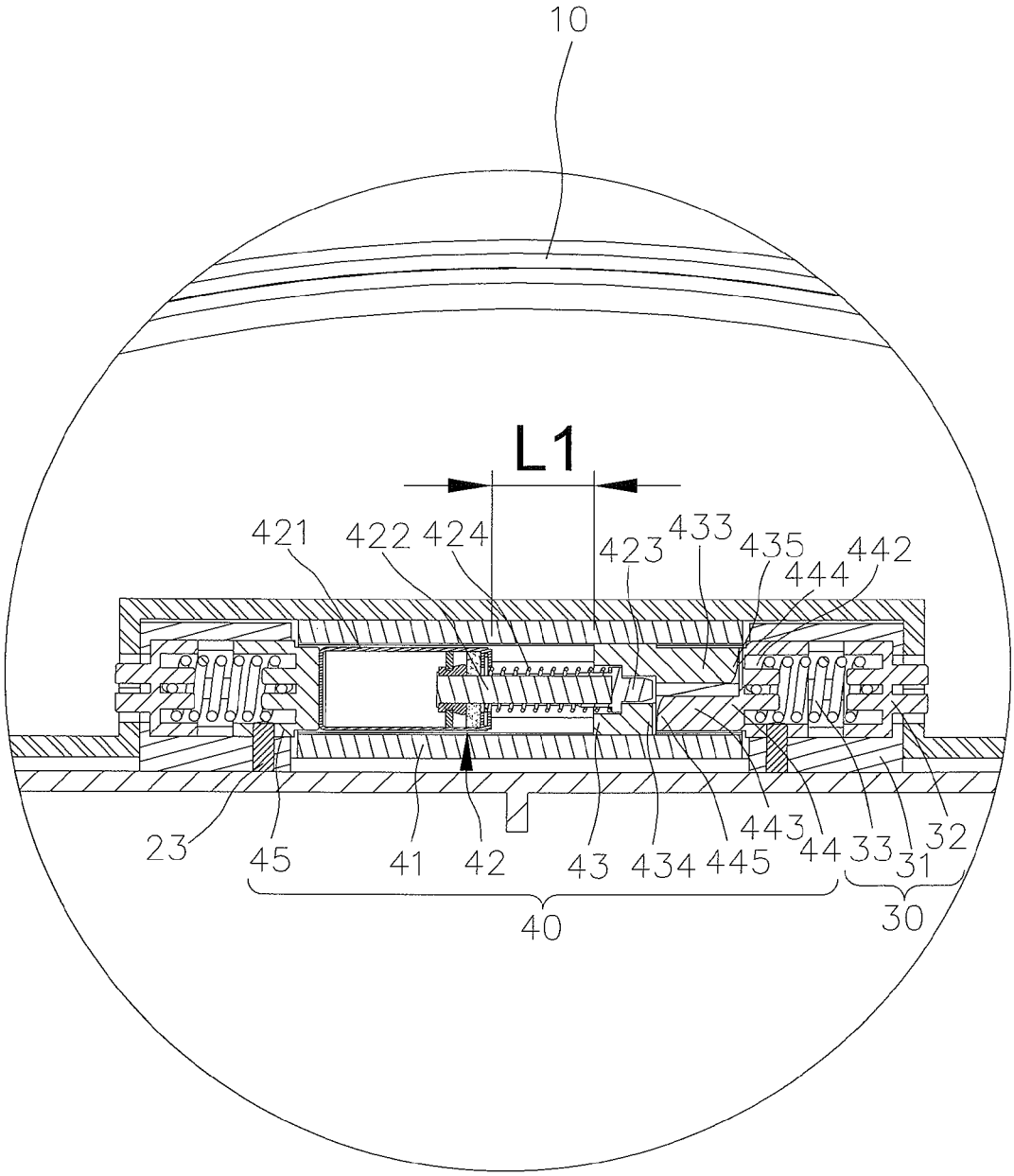
FIG. 4 is an enlarged detailed sectional view taken in FIG. 3, illustrating a driving element in a first position.
Figure 5:
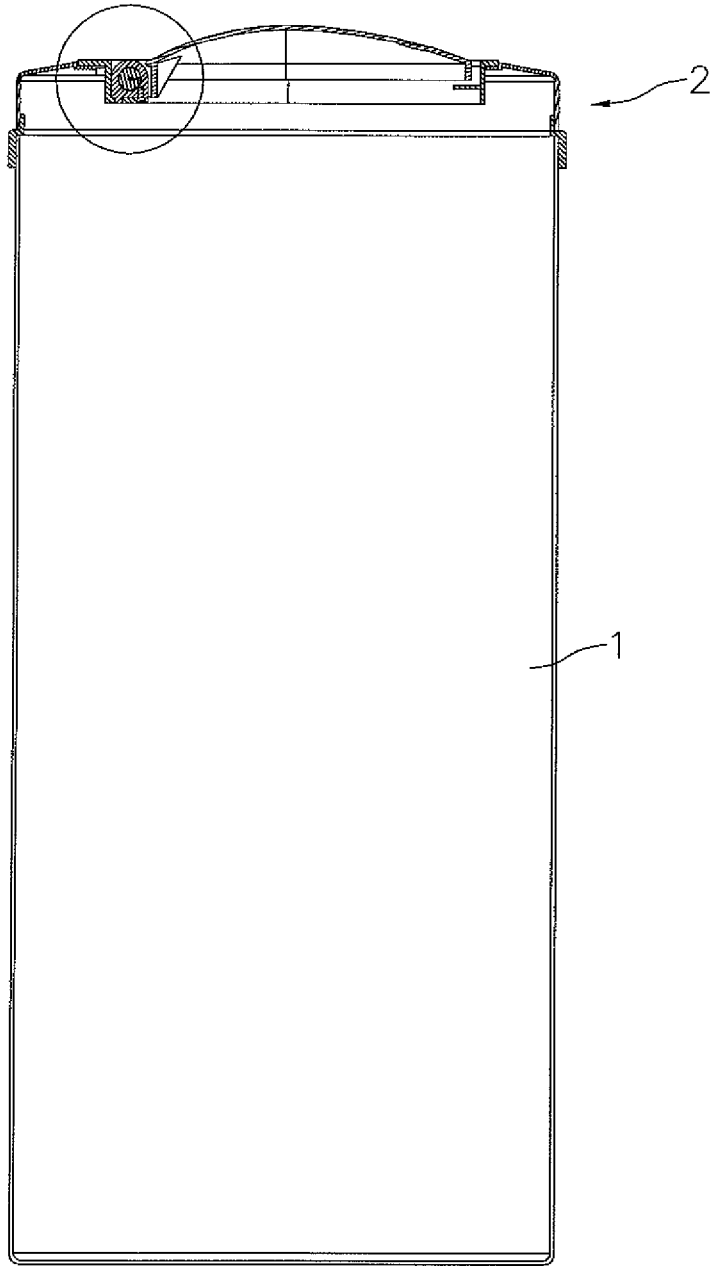
FIG. 5 is a cross-sectional view taken along line 5-5 in FIG. 1, illustrating the cover mounted on the support ring.
Figure 6:
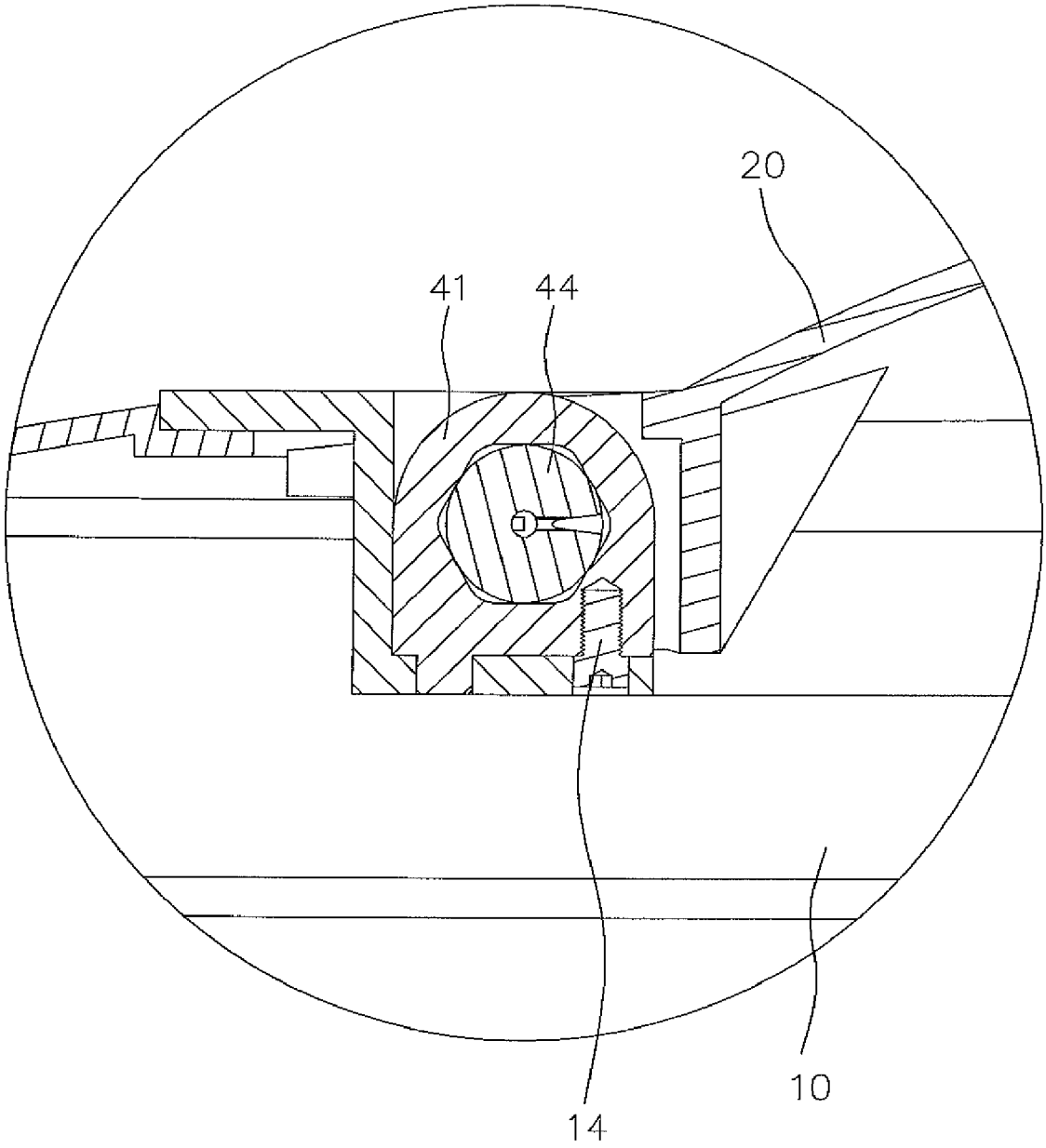
FIG. 6 is an enlarged detailed sectional view taken in FIG. 5, illustrating the driving element in the first position.

A trash bin according to a first embodiment of the present invention is shown in the drawings and includes a bin 1 and a cover assembly 2 installed on and covering the bin 1. The cover assembly 2 includes a support ring 10 disposed on the top edge of the bin 1, a cover 20 mounted on the support ring 10, two pivoting devices 30 connecting to a side of the cover 20 for installing the cover 20 onto a side of interior edge of the support ring 10 relative to the cover 20 and a buffer device 40 disposed on the support ring 10. Two ends of the buffer device 40 are respectively adapted for abutting with the pivoting devices 30.

The support ring 10 includes a compartment 11 defined on the side thereof where the cover 20 is installed and adapted to receive the pivoting devices 30 and the buffer device 40, A plurality of fixed holes 12 is provided on the bottom of the compartment 11 for locating the buffer device 40 on the compartment 11 via a plurality of fixed elements 14 and two engaging holes 13 respectively formed on two sides of the compartment 11, with each of the engaging holes 13 engaging to a corresponding pivoting device 30. The engaging holes 13 are not circular. In the preferred form, the engaging holes 13 are polygonal in section.

The cover 20 includes a connecting flat 21 allowing each of the pivoting devices 30 to abut against the external side thereof. Two connecting holes 22 are defined on the connecting flat 21, with each pivoting device 30 fixed on the external side of the connecting flat 21 via an engaging element 23. A hook 24 is formed on the interior surface of the cover 20 and opposite to the connecting flat 21 for keeping the cover 20 mounted on the support ring 10.

Each of the pivoting devices 30 includes a block 31 that has a polygonal through-hole 311 and an screwed protrusion 312 formed on the side thereof and received in the connecting holde 22 of the connecting flat 21. The cover 20 is connected to each of the pivoting devices 30 via the engagement of each of the engaging elements 23 and each of the screwed protrusions 312. A coupling element 32 mounts in the through-hole 311 and has an engaging end 321 formed on an end thereof and exposed from the through-hole 311 for engaging with each of the engaging holes 13. A recess 322 is defined on another end of the coupling element 32. An end of an elastic element 33 is received in the recess 322 of the coupling element 32, and another end of the elastic element 33 abuts with the relative end of each buffer device 40. In the preferred form, each of the elastic elements 33 is a torsion spring.

The buffer device 40 includes a tube 41 that is fixed on the compartment 11 via the engagement of the fixed elements 14 and the tube 41 through the fixed holes 12. A polygonal through-hole 411 is formed longitudinally in the tube 41, and an adjusting element 42 is disposed in the interior of the through-hole 411 of the tube 41. The adjusting element 42 has a shaft 421 formed on an end thereof and a pin 422 formed on another end thereof opposite to the shaft 421. An elastic element 424 is mounted on the pin 422, and a protrusion 423 is formed on an end of the pin 422 and exposed from the elastic element 424. In the preferred form, the elastic element 424 of the adjusting element 42 is a compression spring.

The buffer device 40 further includes a pressed element 43 abutting with the pin 422 of the adjusting element 42 and having a first end 431 formed on an end thereof and disposed in the through-hole 411. A hole 432 is defined in the interior of the first end 431 and receiving the protrusion 423 therein. The pressed element 143 further has a second end 433 formed on another end thereof opposite to the first end 431.

The first end 431 is polygonal in section and corresponds with the form of the through-hole 411 of the tube 41 so that the first end 431 would not turn relative to the tube 41. The second end 433 is an edge cam in section and includes a first point 434 by the first end 431 and a second point 435.

The buffer device 40 further includes a driving element 44 that has a first end 441 formed on an end thereof and protruding from the tube 41 to be disposed in the through-hole 311 of the block 31. A hole 442 is defined in the interior of the first end 441 and receives the elastic elements 33. The driving element 44 has a second end 443 formed on another end thereof opposite to the first end 441.

The first end 441 is polygonal in section and corresponds with the form of the through-hole 311 of the block 31 so that the first end 441 cannot be turned relative to the block 31. The second end 443 is an edge cam in section and includes a first point 444 by the first end 441 and a second point 445. The second end 443 of the driving element 44 is adapted for pressing the second end 433 of the pressed element 43.

The buffer device 40 further includes a connecting element 45 abutting with the shaft 421 of the adjusting element 42 and having a first end 451 formed on an end thereof and disposed in the through-hole 411. A hole 452 is defined in the interior of the first end 451 and receives the elastic element 33 therein. The connecting element 45 has a second end 453 formed on another end thereof opposite to the first end 451 and disposed in the through-hole 411 to press the adjusting element 42.

The first end 451 is polygonal in section and corresponds with the form of the through-hole 411 of the tube 41 so that the first end 451 cannot be turned relative to the tube 41.

Referring to FIGS. 3 to 6, the cover 20 is mounted on the support ring 10, the elastic element 33 is tortile, and the driving element 44 of the buffer device 40 is in a first position. Simultaneously, the form of the second end 443 of the driving element 44 coincides with the form of the second end 433 of the pressed element 43, and, hence, the second point 445 of the driving element 44 presses the first point 434 of the pressed element 43. Therefore, the elastic element 424 of the adjusting element 42 is released and not pressed, and the length of the elastic element 424 is L1.

Figure 7:
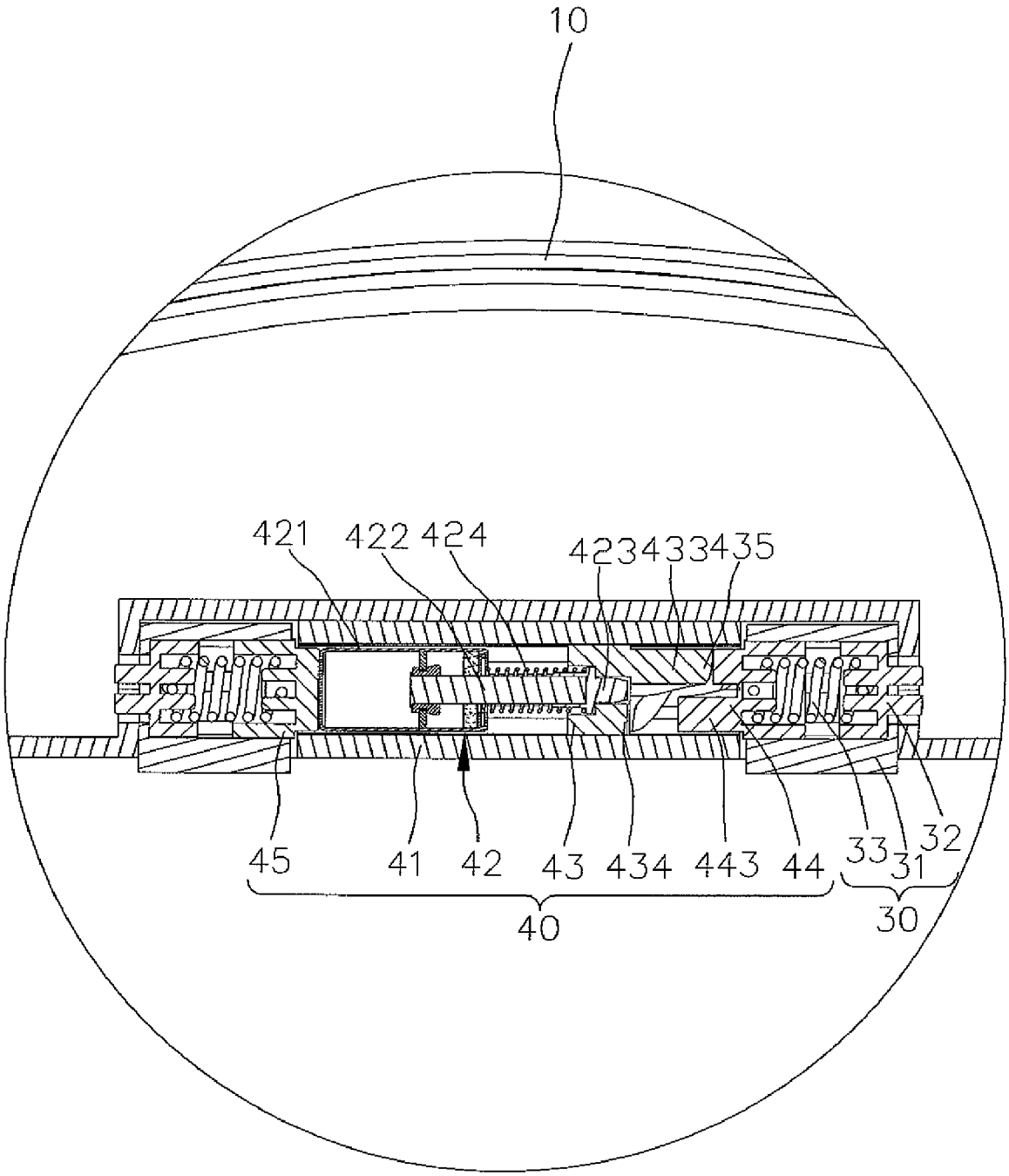
FIG. 7 is similar to FIG. 4, illustrating the cover being lifted.
Figure 8:
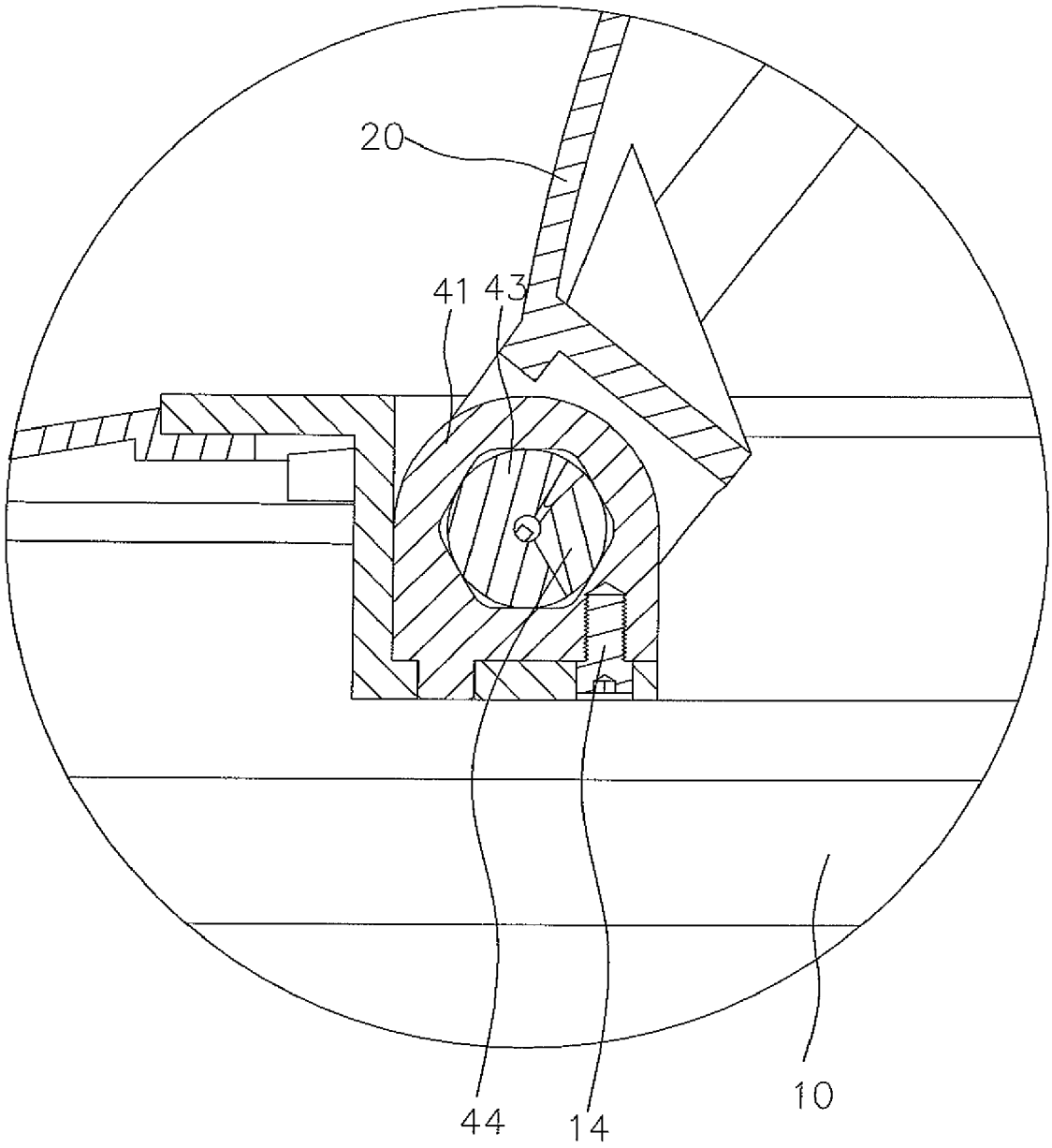
FIG. 8 is similar to FIG. 6, illustrating the cover being lifted.

Referring to FIGS. 7 to 8, when the cover is pressed and away from the support ring 10, the elastic element 33 is released. The driving element 44 is driven to turn in the through-hole 411 of the tube 41 via the torsion of the elastic element 33, and the second end 443 of the driving element 44 would be turned along the second end 433 of the pressed element 43 to press the pressed element 43 toward the tube 41. Simultaneously, the connecting element 45 is driven to press the adjusting element 42 via the torsion of the elastic element 33. Therefore, the adjusting element 42 is pressed by the pressed element 43 and the elastic element 33. The torsion of the elastic element 33 is larger than the elasticity of the elastic element 424 of the adjusting element 42.

Figure 9:
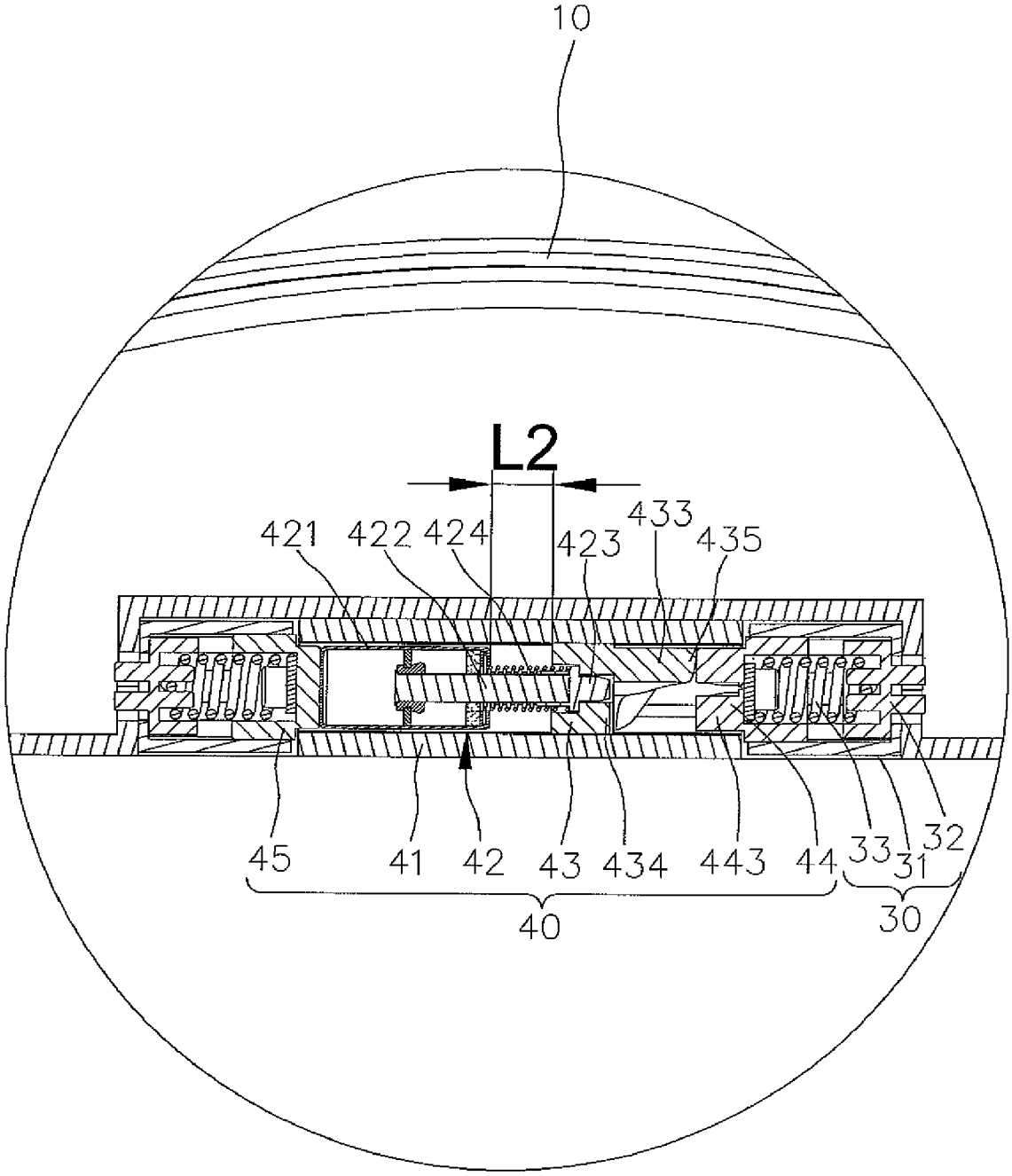
FIG. 9 is similar to FIG. 4, illustrating the cover being lifted to the limit.
Figure 10:
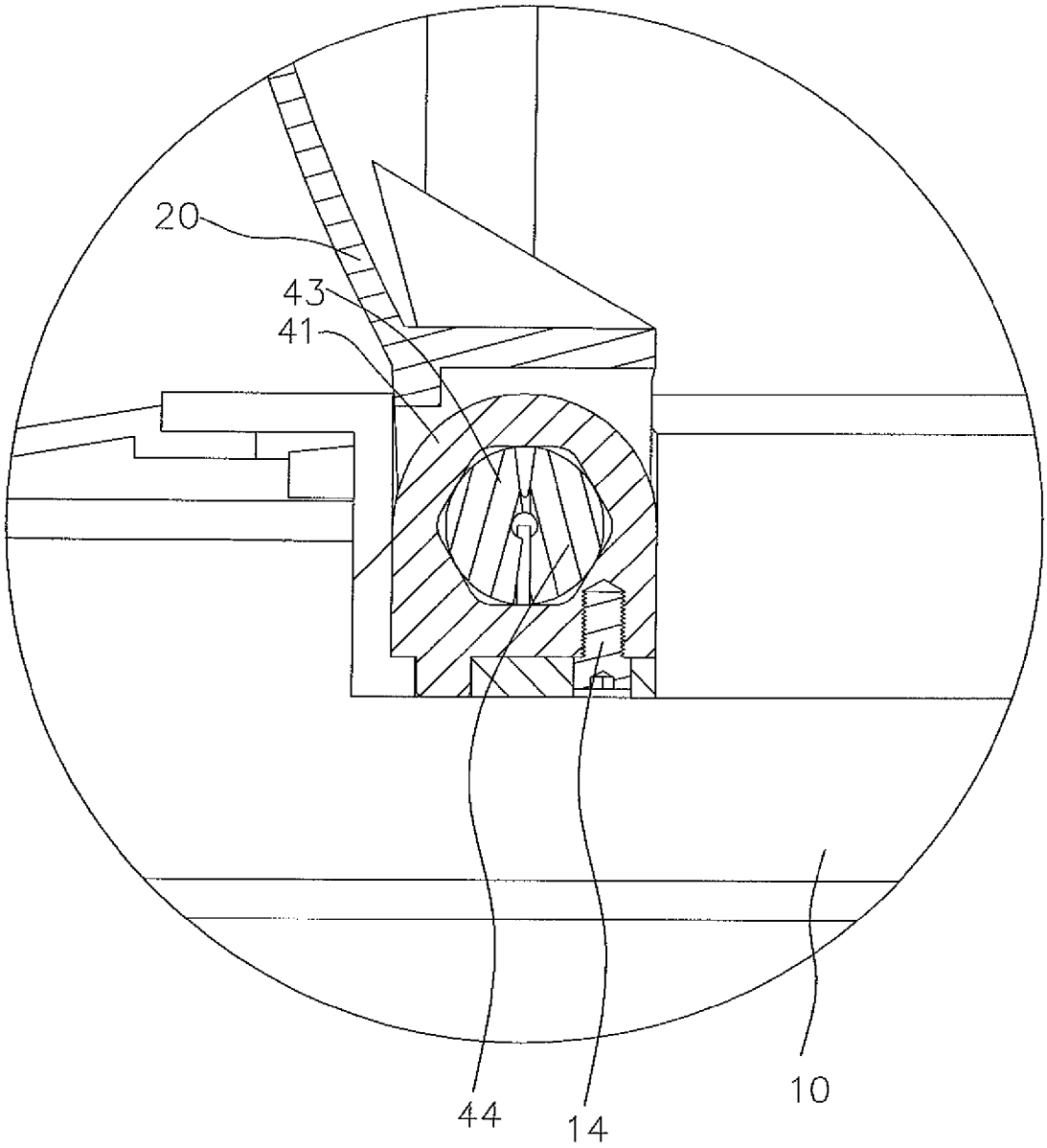
FIG. 10 is similar to FIG. 6, illustrating the cover being lifted to the limit.
Figure 11:
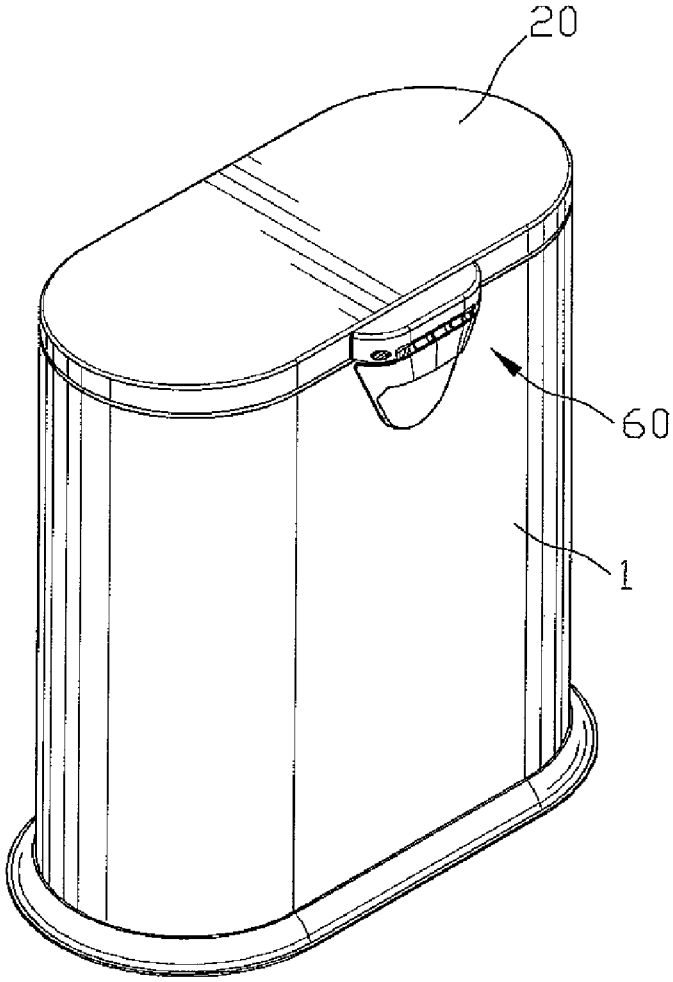
FIG. 11 shows a perspective view of a trash bin according to a second embodiment of the present invention.
Figure 12:
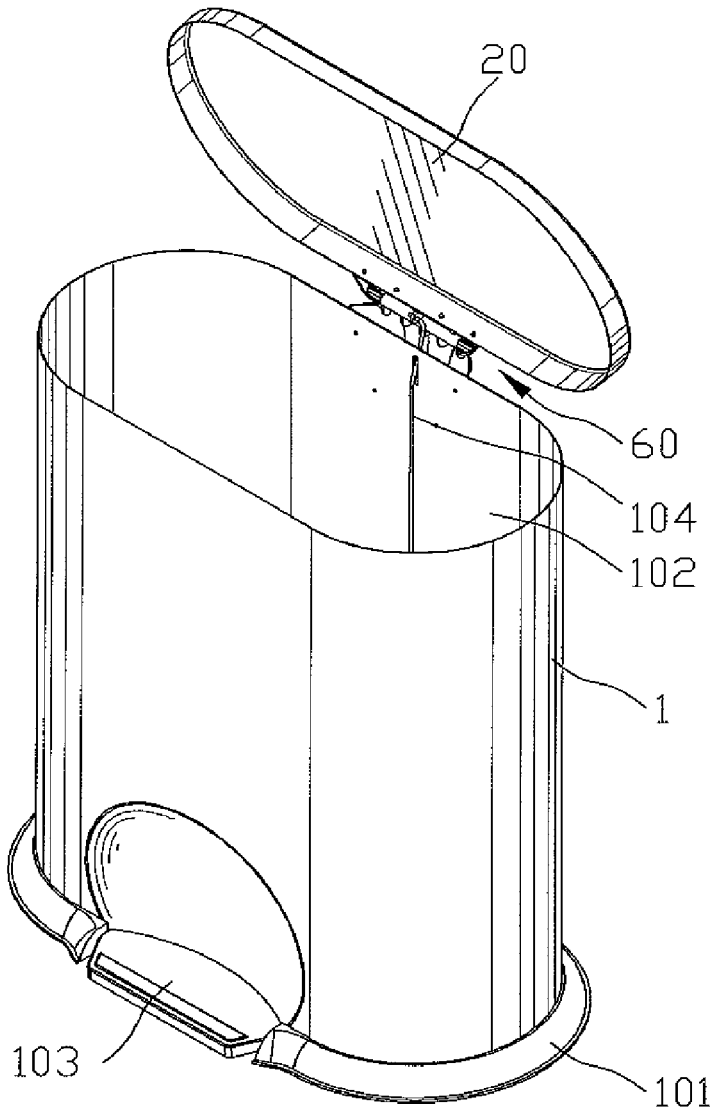
FIG. 12 is similar to FIG. 11, illustrating the cover being lifted.
Figure 13:
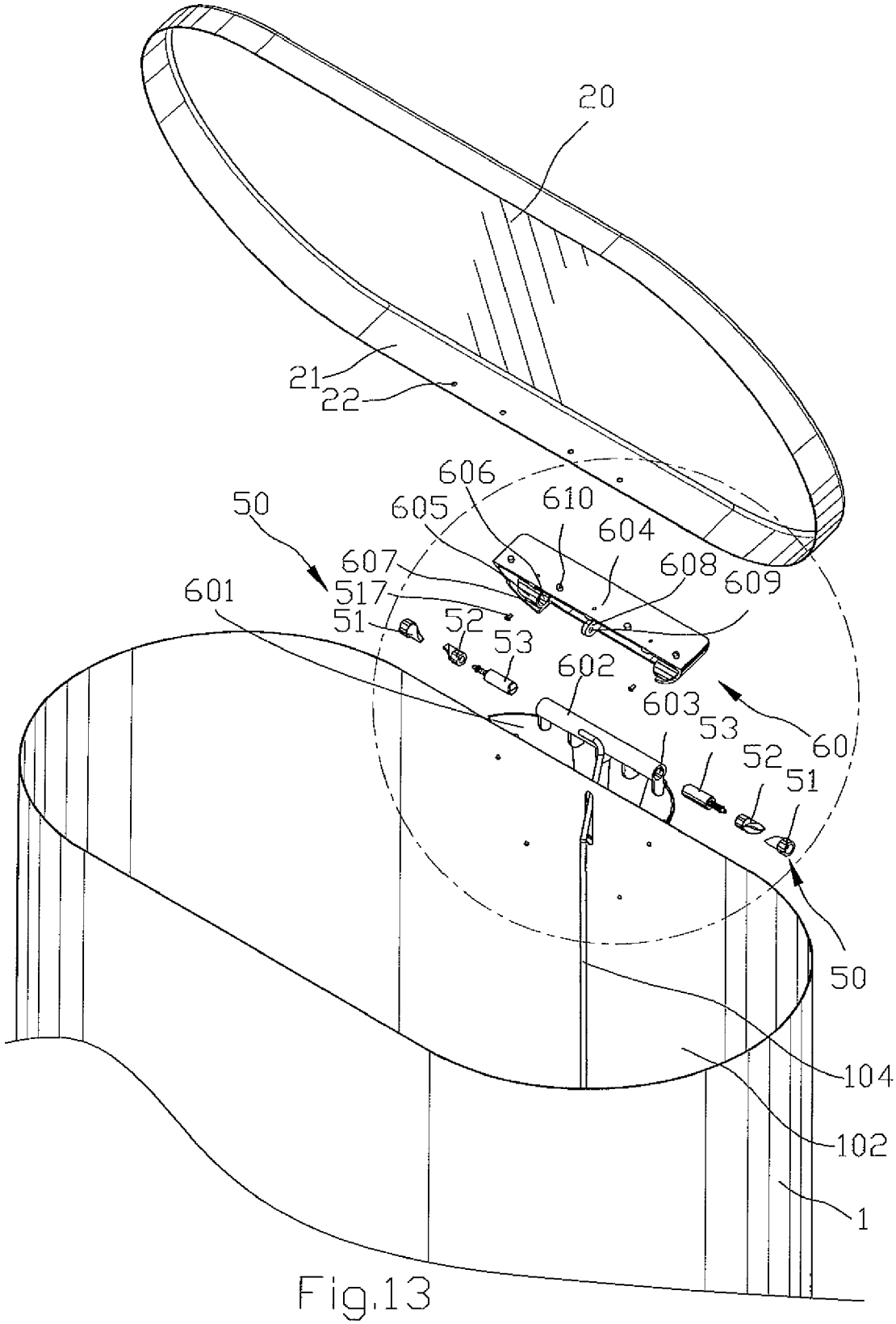
FIG. 13 shows a partial exploded view of the trash bin according to the second embodiment of the present invention.
Figure 14:
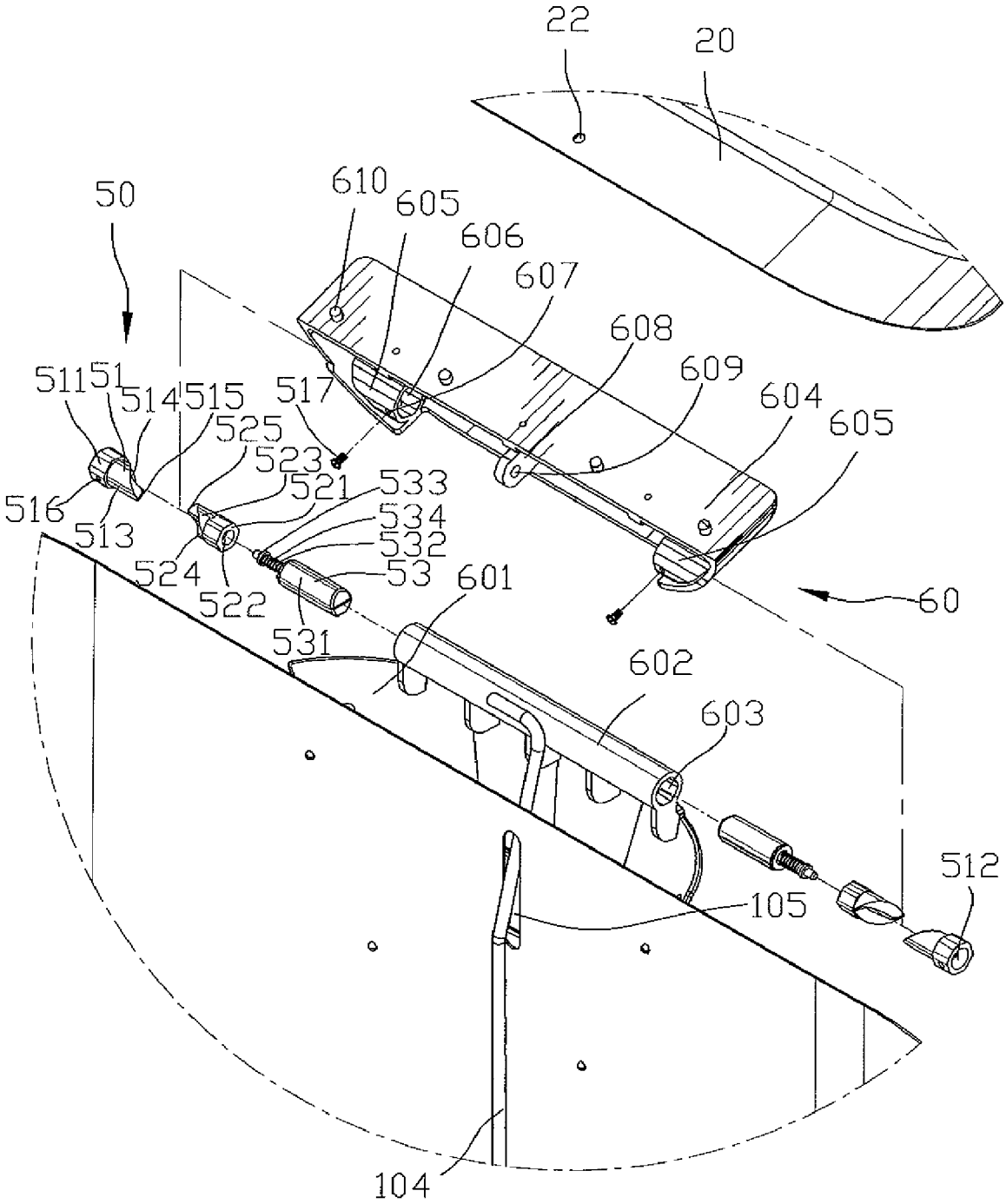
FIG. 14 is an enlarged partial view of FIG. 13.

Referring to FIGS. 9 to 10, when the cover is open and perpendicular to the support ring 10, the driving element 44 of the buffer device 40 is in a second position. Simultaneously, the second point 435 of the pressed element 43 does not abut with the first point 444 of the driving element 44 so that the length between the first end 431 of the pressed element 43 and the first end 441 of the driving element 44 would increase than when the driving element 44 is in the first position. Hence, the elastic element 424 of the adjusting element 42 would be pressed, and the length of the elastic element 424 is L2. L2 is smaller than L1.

The elastic element 424 would be pressed by an external force, and the elasticity of the elastic element 424 is smaller than the torsion of the elastic element 33, so that the elasticity of the elastic element 424 would not prevent the torsion of the elastic element 33 from opening the cover 20. However, the elasticity of the elastic element 424 could decrease the torsion of the elastic element 33 and weaken the transient force from the elastic element 33 to open the cover 20. The foregoing provides a buffer effect while opening the cover 20.

The cover assembly 2 of the trash bin according to the preferred embodiment of the present invention allows quick and quiet operation without troublesome grouping encountered with the prior art cover assemblies of trash bins. The pivoting device 30 includes the elastic element 33 providing torsion to open the cover 20 quickly, and the buffer device 40 includes the elastic element 424 pressed by the pressed element 43 and providing elasticity which is smaller than the torsion of the elastic element 33 to decrease the torsion to buffer the force to open the cover 20. While the elastic element 33 of the pivoting device 30 is released via pressing 18 and opening the cover 20, the driving element 44 would turn by the torsion of the elastic element 33 and pushing the pressed element 43 to press the elastic element 424 of the adjusting element 42. Simultaneously, the connecting element 45 would be pushed by the torsion of the elastic element 33 to press the shaft 421 of the adjusting element 42. However, the elastic element 424 needs an exterior force to be pressed and could cushion a part of torsion of the elastic element 33. Thus, the buffer device 40 could slow down the speed of opening the cover 20 and prevent noise from opening the cover 20 quickly.

Referring to FIGS. 11 to 14 showing a second embodiment in accordance with the present invention, the bin 1 pivotally connects with the cover 20 via a hinge assembly 60. In the embodiment, the bin 1 is in the form of a cylinder and includes a base 101 formed on an end thereof opposite to the cover 20, an opening 102 defined on the top thereof, a pedal 103 disposed on a side of the base 101 and a rod 104 provided on the interior wall of the bin 1 opposite to the pedal 103 and inserted outward through a slot 105 which is defined on the wall of the bin adjacent to the opening 102. The rod 104 is adapted to be driven via stepping the pedal 103 and connects to the hinge assembly 60, and an end of the rod 104 is bent.

The hinge assembly 60 includes a mount 601 fixed on the outer wall of the bin 1 adjacent to the slot 105, and a tube 602 is installed on the mount 601. A polygonal through-hole 603 is formed longitudinally in the interior of the tube 602. A connective member 604 is disposed on the outer periphery of the connecting flat 21 of the cover assembly 2 and fixed into the holes 22 on the connecting flat 21 via a plurality of protrusions 610 that corresponds to the holes 22.

Two receiving portions 605 are respectively arranged on two ends of a side of the connective member 604. An end of each receiving portion 605 forms a polygonal receiving hole 606 longitudinally, and another end of each receiving portion 605 is closed. A fixed aperture 607 is transversely defined on the wall of each receiving portion 605. A block 608 protrudes from the side of the connective member 604 between two receiving portions 605 and defines an orifice 609 therethrough. The orifice 609 is adapted to be hooked via the rod 104.

The mount 601 and the connective member 604 are respectively fixed onto the bin 1 and the cover 20, and two ends of the tube 602 on the mount 601 respectively correspond to each receiving portion 605 on the connective member 604. Simultaneously, a buffer device 50 is disposed between the through-hole 603 and each receiving hole 606 and is provided for connecting the mount 601 to the connective member 604 so as to weaken the force of closing the cover 20.

In the second embodiment, two buffer devices 50 are respectively disposed in two ends of the through-hole 603 of the hinge assembly 60. Furthermore, the through-hole 603 is divided into two parts so as to separate the two buffer devices 50 therein.

Each buffer device 50 is similar to the buffer device 40 and includes a driving element 51, a pressed element 52 and an adjusting element 53.

The driving element 51 has a first end 511 formed on an end thereof and disposed in the receiving hole 606, a hole 512 defined in the interior of the first end 511, a second end 513 formed on another end thereof opposite to the first end 511 and a fixed aperture 516 on the outer periphery of the driving element 51. The fixed aperture 516 corresponds to the aperture 607 on the receiving portion 605, and the driving element 51 is fixed in the receiving fastener 517 inserted in the fixed aperture 516 through the aperture 607. The first end 511 is polygonal in section and corresponds with the form of the receiving hole 606 of the hinge assembly 60 so that the first end 511 cannot be turned relative to the receiving portion 605. The second end 513 is an edge cam in section and includes a first point 514 by the first end 511 and a second point 515.

The pressed element 52 has a first end 521 formed on an end thereof and disposed in an end of the through-hole 603, a hole 522 defined in the interior of the first end 521 and a second end 523 formed on another end thereof opposite to the first end 521. The first end 521 is polygonal in section and corresponds with the form of the through-hole 603 of the tube 602 so that the first end 521 cannot be turned relative to the tube 602. The second end 523 is an edge cam in section and includes a first point 524 by the first end 521 and a second point 525. The first end 521 of the pressed element 52 is adapted to be pressed by the second end 513 of the driving element 51.

The adjusting element 53 is disposed in the interior of the through-hole 603 of the tube 602 and has a shaft 531 formed on an end thereof, a pin 532 disposed therein and protruding from another end thereof opposite to the shaft 531 and received in the hole 522 of the pressed element 52, an elastic element 534 mounted on the pin 532 and a protrusion 533 formed on an end of the pin 532 and exposed from the elastic element 534. A plunger 535 is provided in the interior of the shaft 531 abutting against the pin 532 (shown as FIG. 16). In the preferred form, the adjusting element 53 is a gas lift.

Figure 15:
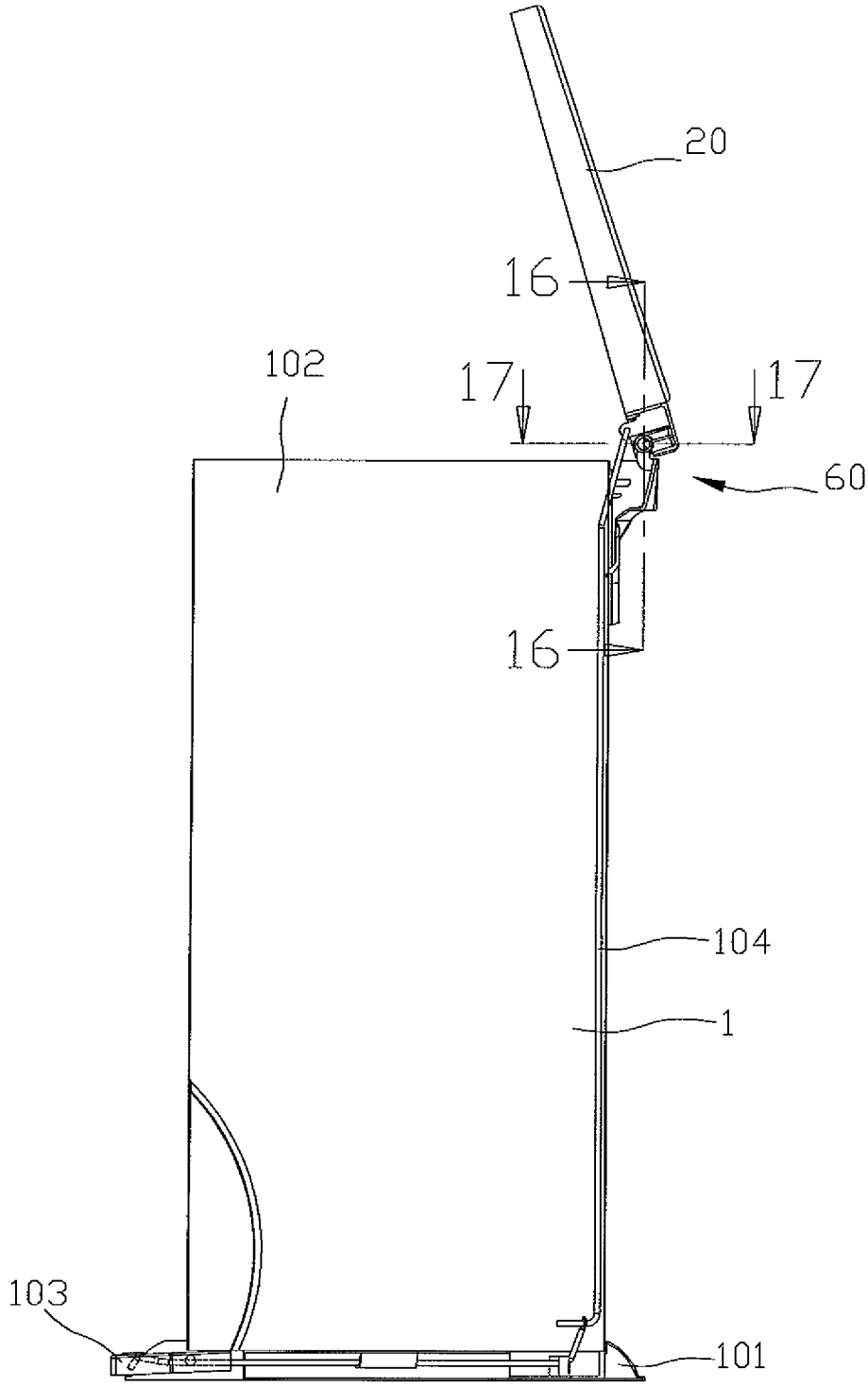
FIG. 15 is a side view of the trash bin according to the second embodiment of the present invention, illustrating stepping on the pedal to drive the cover to be lifted.
Figure 16:
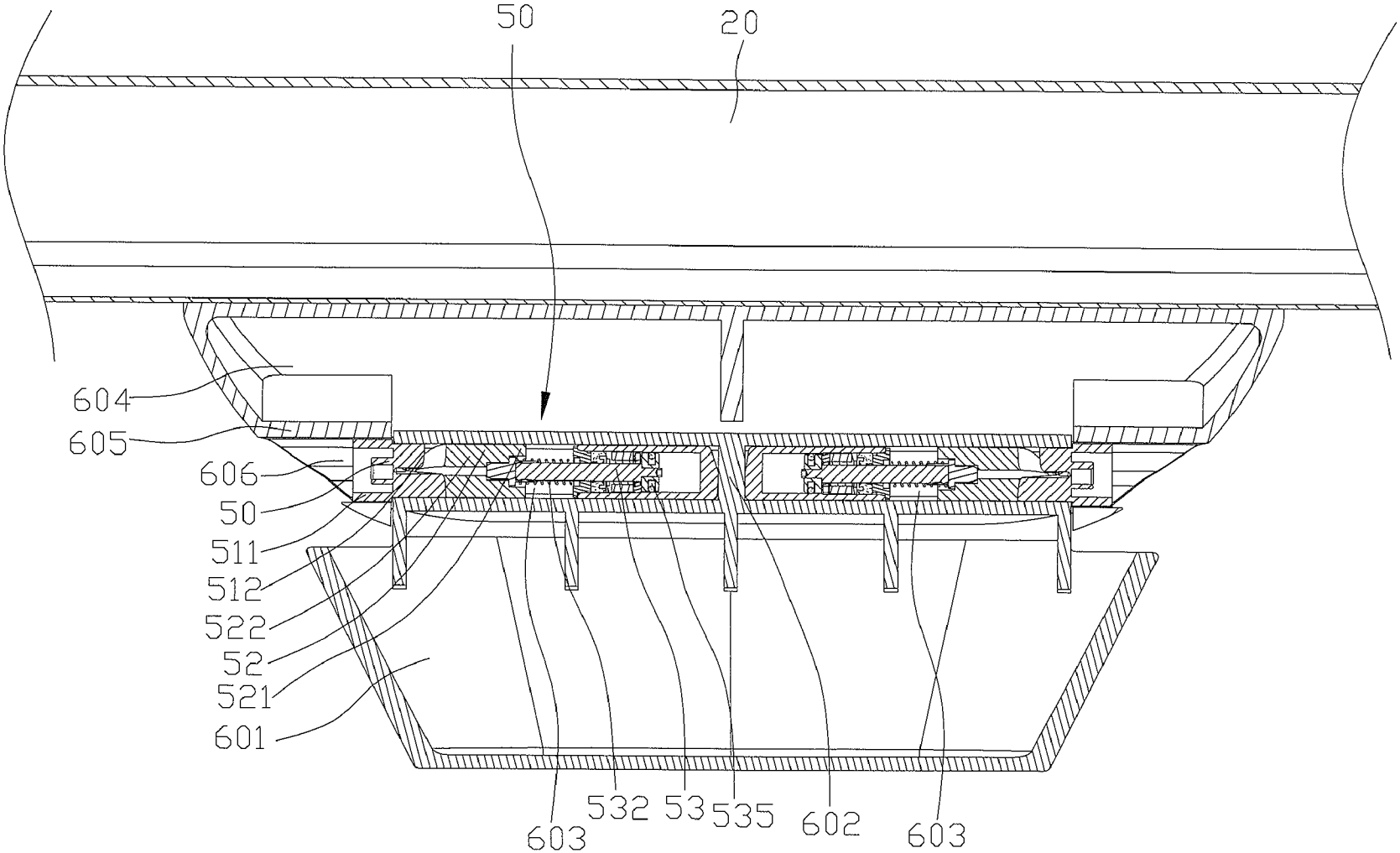
FIG. 16 is a cross-sectional view taken along line 16-16 in FIG. 15, illustrating the cover being lifted and the buffer device being driven via the cover.
Figure 17:
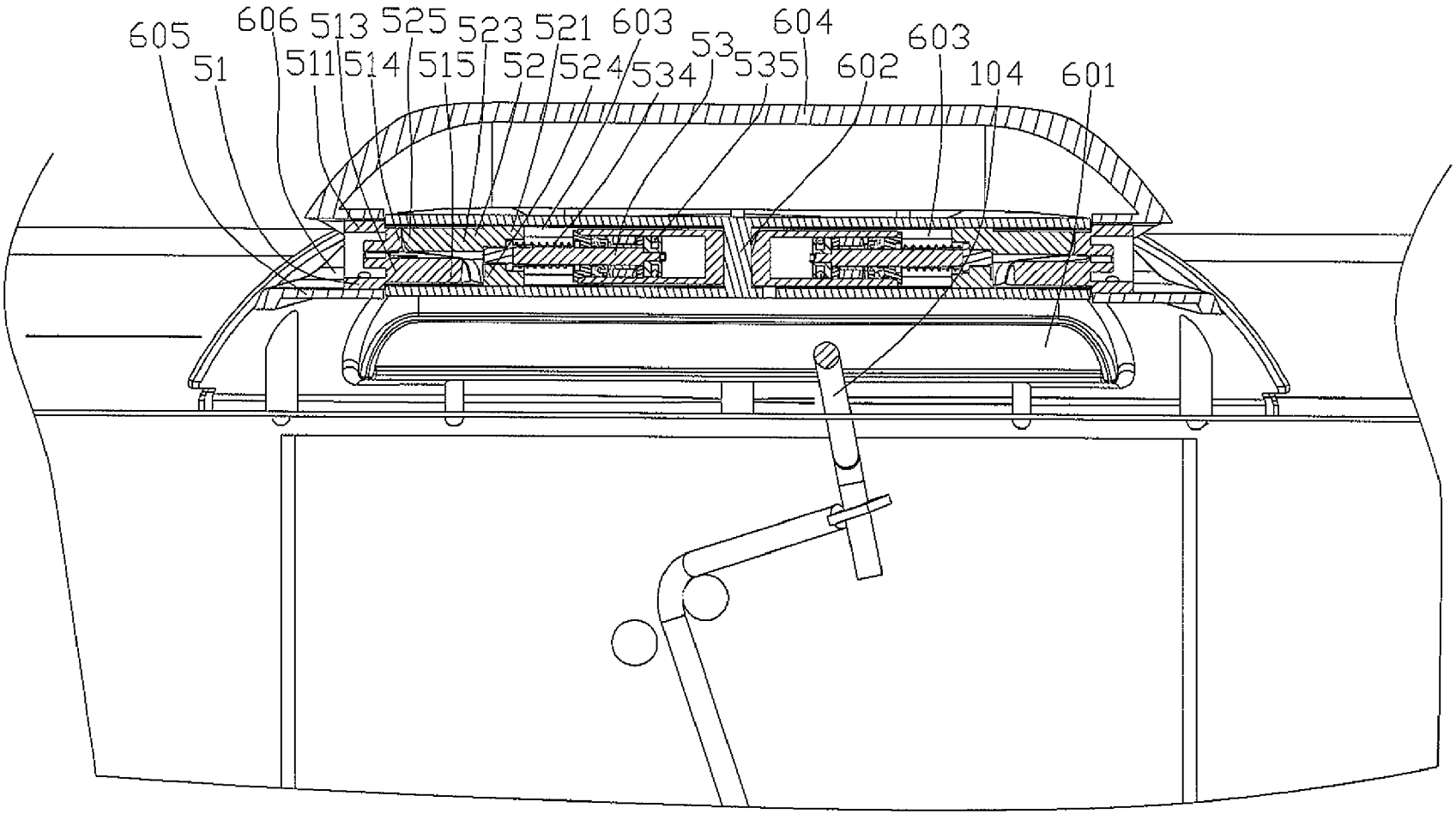
FIG. 17 is a cross-sectional view taken along line 17-17 in FIG. 15, illustrating the cover being lifted and the buffer device being driven via the cover.

Referring to FIGS. 15 through 17, when users step on the pedal 103 to drive the rod 104 to be lifted, the first end 511 of the driving element 51 is fixed in the received hole 606 of the received portion 605 and pivots relative to the mount 601 so that the first point 514 of the driving element 51 abuts against the second point 525 of the pressed element 52 and the second point 515 of the driving element 51 abuts against the first point 524 of the pressed element 52. Also, the second ends 513, 523 coincide with each other.

While lifting the cover 20, the hinge assembly 60 is driven to pivot via the rod 104. Simultaneously, the pressed element 52 pivots relative to the driving element 51, and the transverse movement of the pressed element 52 allows the elastic element 534 of the adjusting element 53 to be released. The driving element 51 is adapted for lifting the connective member 604 relative to the mount 601. The cover 20 would be lifted slowly, because the adjusting element 53 could weaken the force of stepping on the pedal 103 and drive the pressed element 52 to pivot relative to the driving element 51.

Figure 18:
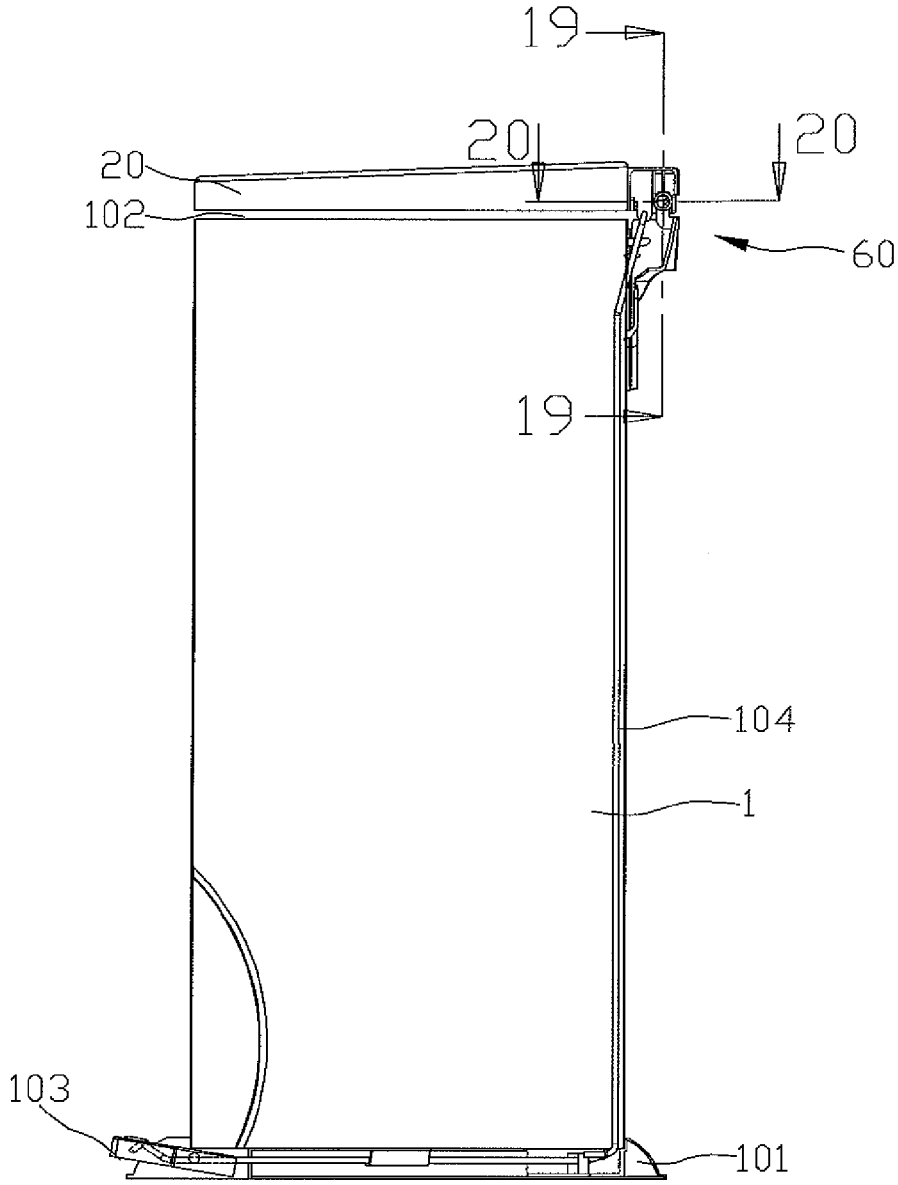
FIG. 18 is similar to FIG. 15, illustrating the cover being closed.
Figure 19:
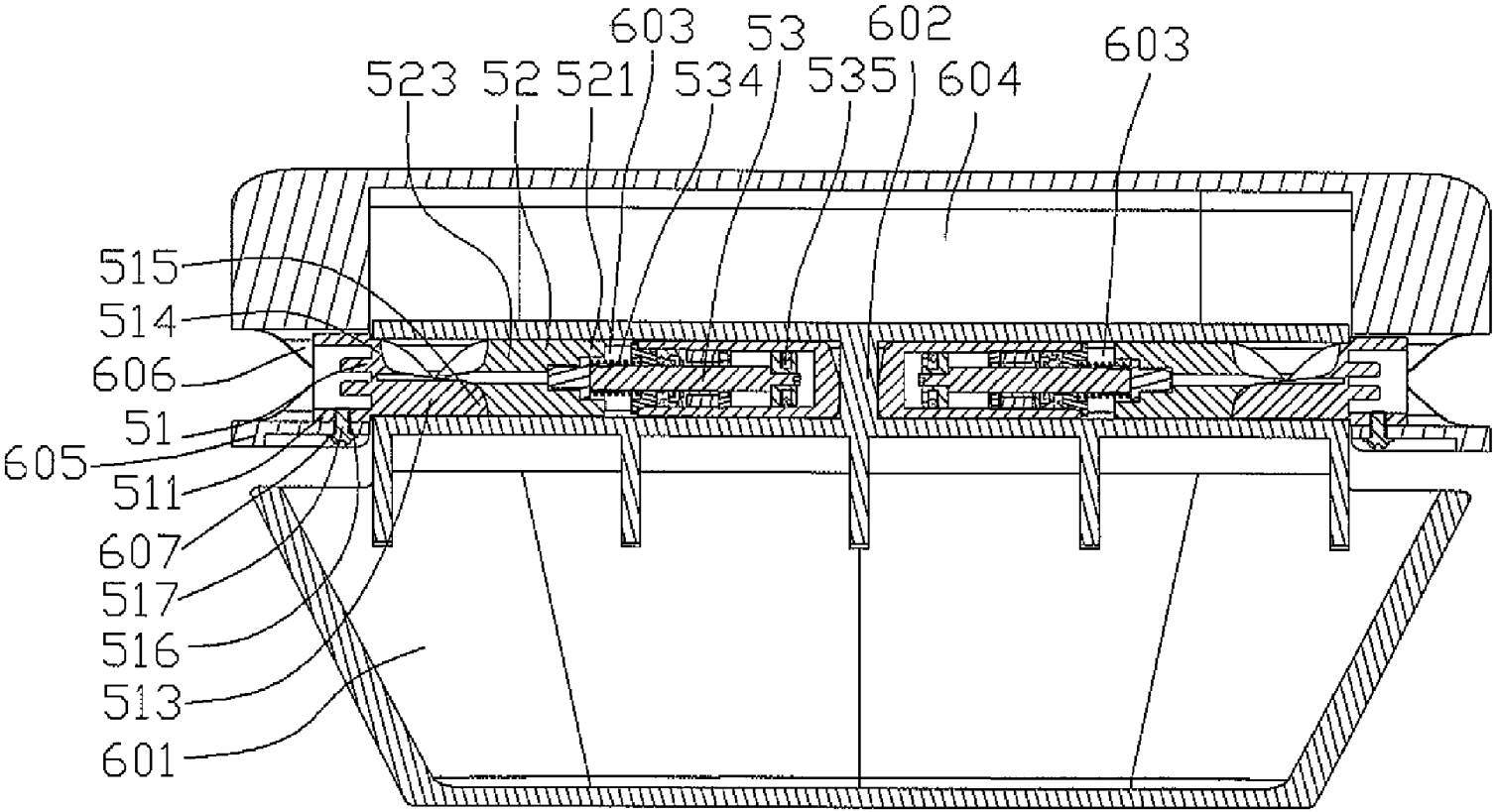
FIG. 19 is a cross-sectional view taken along line 19-19 in FIG. 18, illustrating the cover being closed and the buffer device being driven via the cover.
Figure 20:
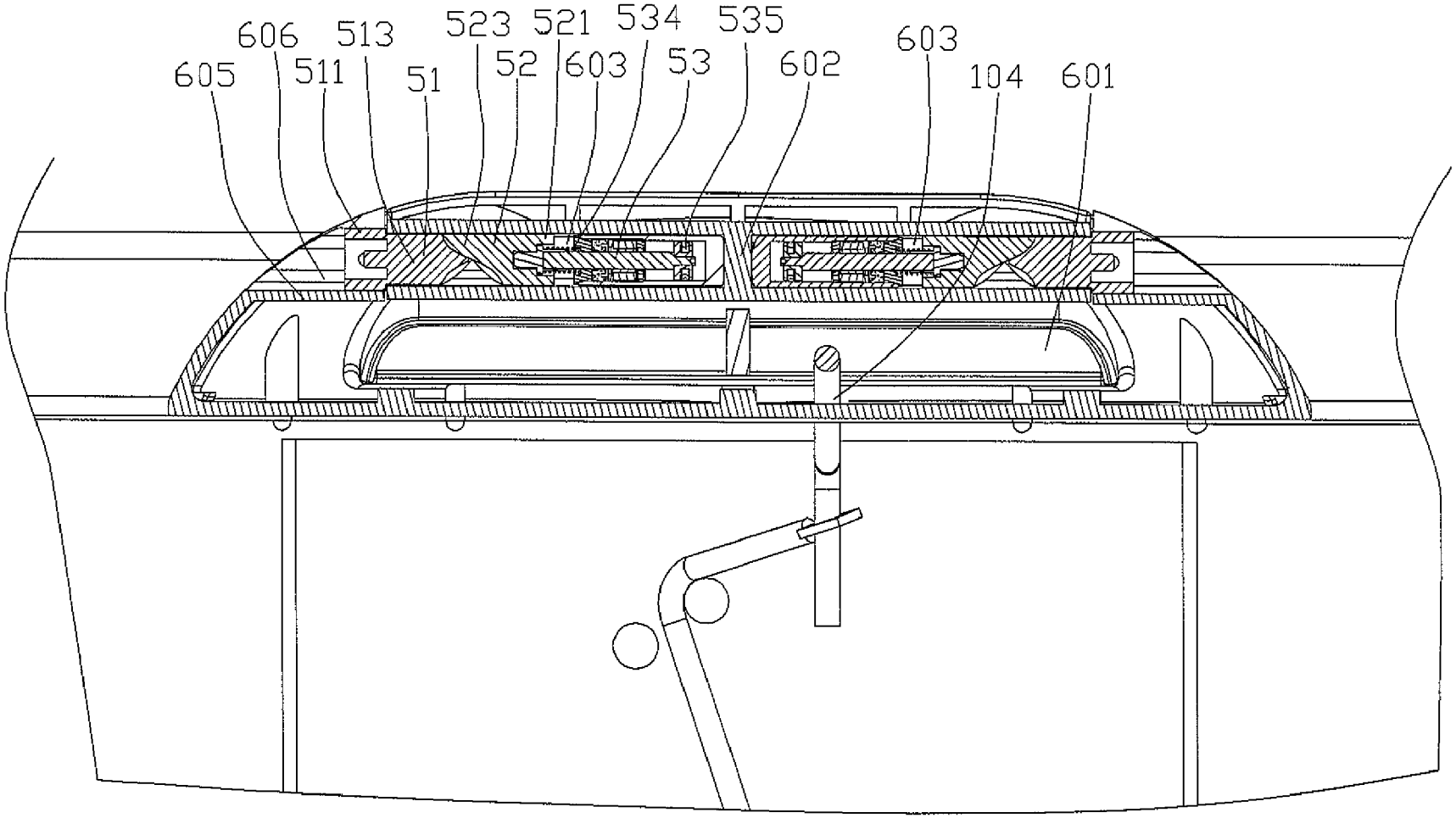
FIG. 20 is a cross-sectional view taken along line 20-20 in FIG. 18, illustrating the cover being closed and the buffer device being driven via the cover.

Referring to FIGS. 18 through 20, with the removal of the force of the stepping on the pedal 103, the cover 20 is closed because of gravitation. The buffer device 50 would weaken such force and prevent the cover 20 from being closed suddenly to make large noise.

While the cover 20 is closed gradually, the driving element 51 is fixed in the receiving hole 606 of the receiving portion 605 and pivots with the connective member 604 so as to drive the pressed element 52 to move transversely in the through-hole 603 of the tube 602. The second end 523 of the pressed element 52 pivots relative to the second end 513 of the driving element 51, and the second point 515 of the driving element 51 presses the second end 523 of the pressed element 52 so as to drive the pressed element 52 to move transversely toward the adjusting element 53. Also, the elastic element 534 of the adjusting element 53 is pressed, and the pin 532 pushes the plunger 535 inward. Therefore, the force that allows the cover 20 to be closed would be weakened by pressing the elastic element 534 and the plunger 535 of the adjusting element 53, and the cover 20 could be closed slowly.

Figure 21:
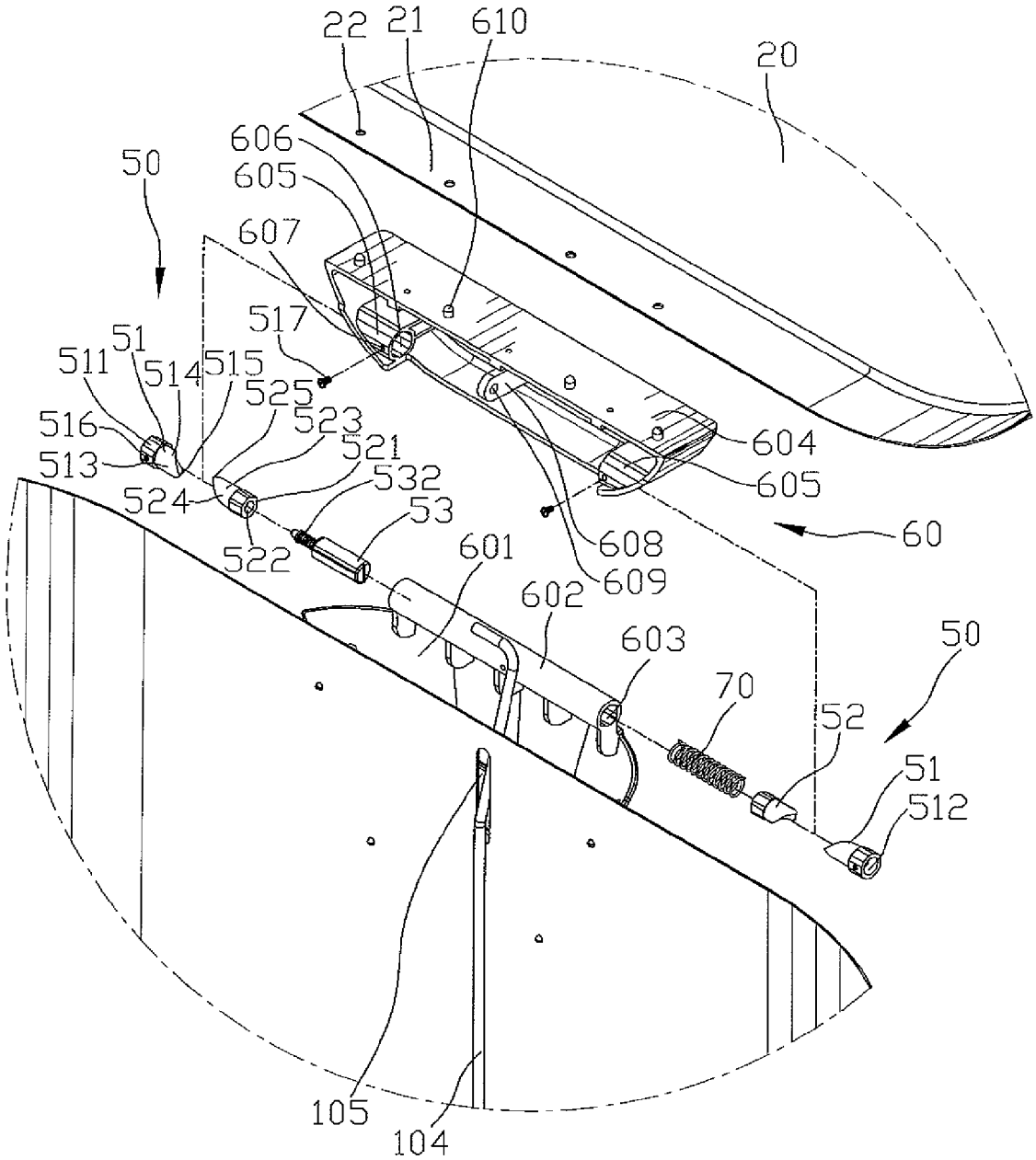
FIG. 21 shows a partial exploded view of the trash bin according to a third embodiment of the present invention.
Figure 22:
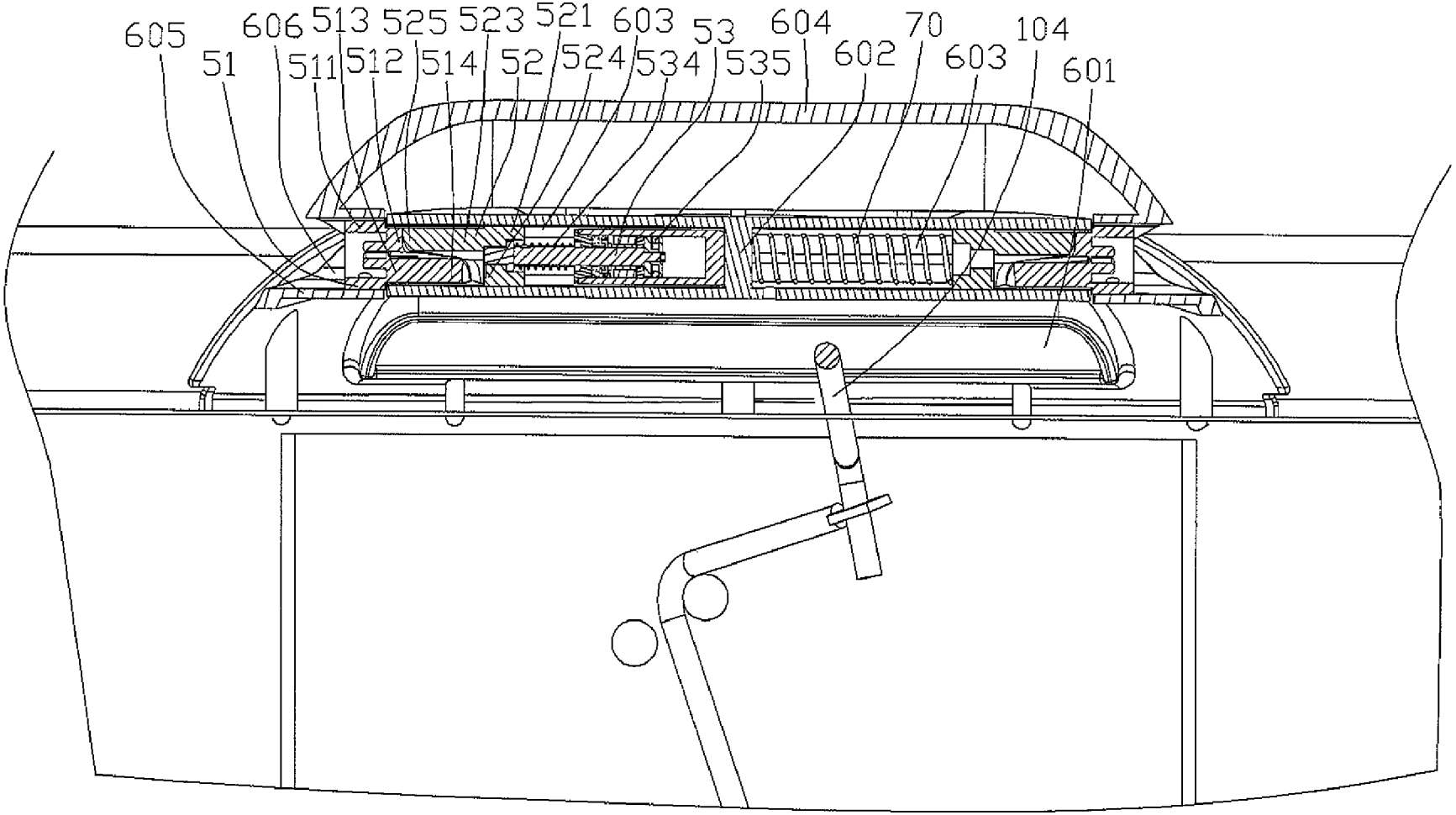
FIG. 22 is similar to FIG. 21, illustrating the buffer device installed to the hinge assembly.

FIGS. 21 and 22 show the third embodiment in accordance with the present invention which is similar to the second embodiment expect that one of the adjusting elements 53 is replaced with a spring 70. The spring 70 is disposed in an end of the through-hole 603 and abuts with the pressed element 52. While the cover 20 is lifted or closed, the spring 70 also weakens the upward or downward force. Also, it would save the cost of materials.

Figure 23:
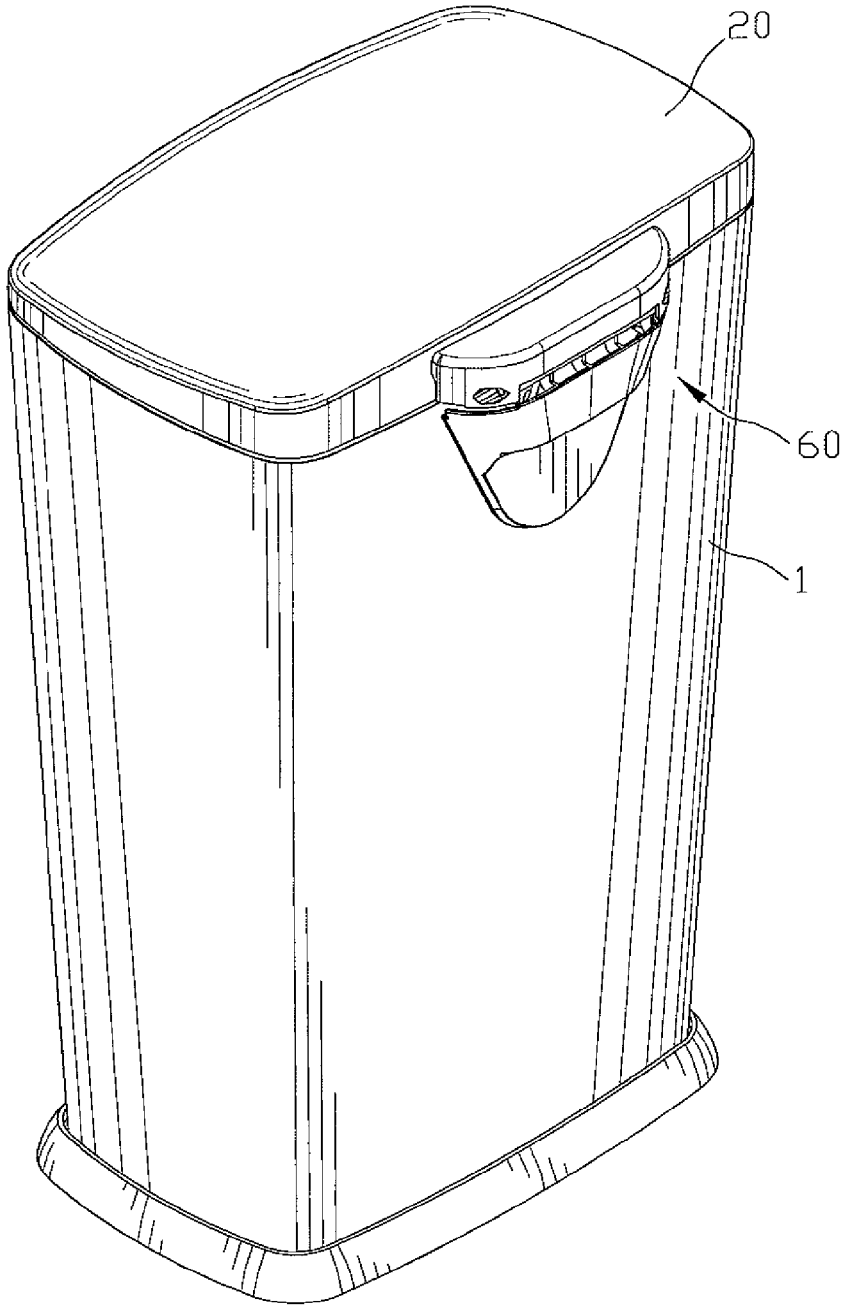
FIG. 23 shows a perspective view of a trash bin according to a fourth embodiment of the present invention.
Figure 24:
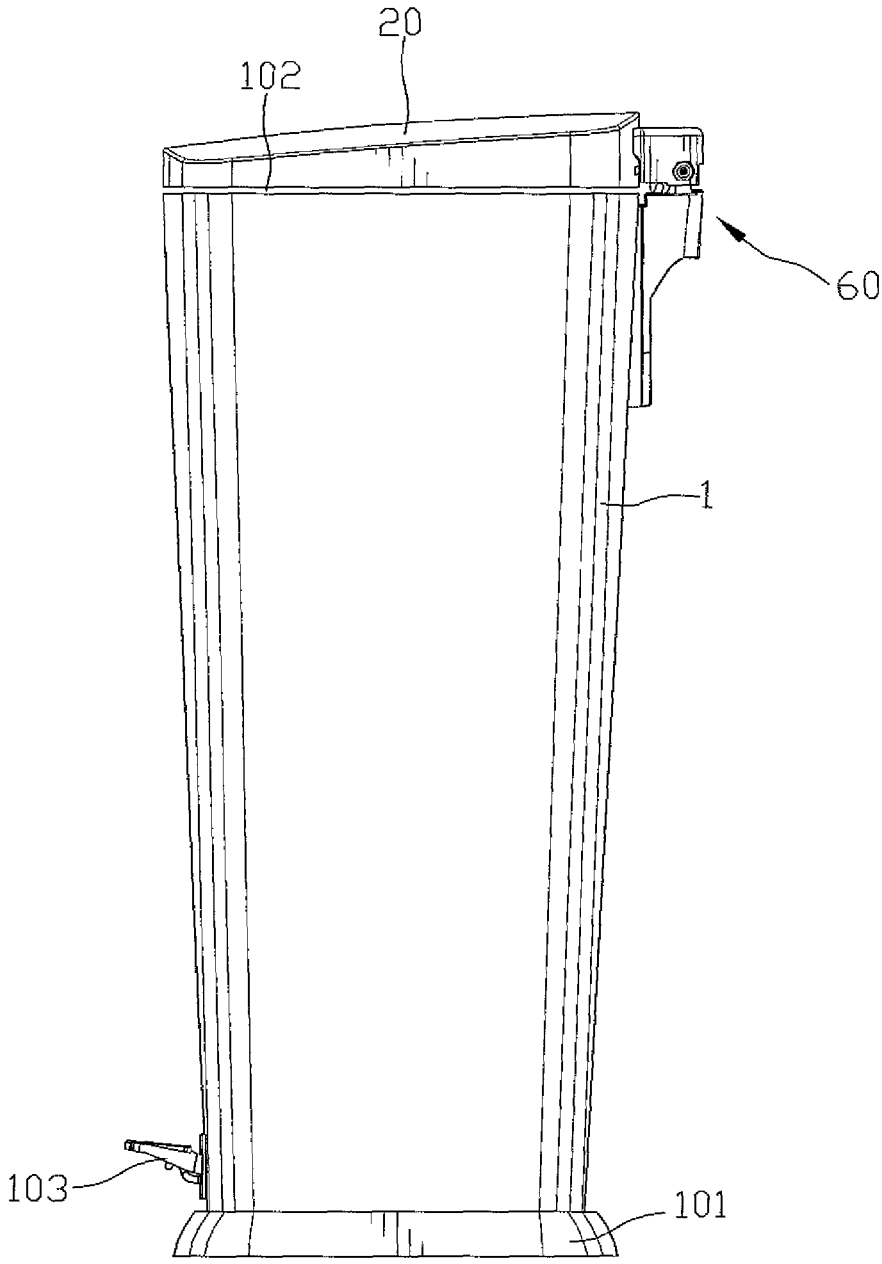
FIG. 24 is a side view of a trash bin according to the fourth embodiment of the present invention.

FIGS. 23 and 24 show the fourth embodiment in accordance with the present invention. The cross-section area of the base 101 is smaller than the cross-section area of the opening 102, so that the bin 1 is in the form of a taper.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come with the meaning and range of equivalency of the claims are intended to be embraced therein.

What is claimed is:

1. A cover assembly for a trash bin which is installed onto a bin of the trash bin, comprising:

a support ring including a compartment axially formed on the interior edge thereof;

a cover installed on a side of the support ring abutting with the compartment and mounted on the support ring;

a pivoting device disposed in the compartment of the support ring and connected to the cover and the support ring, with the pivoting device including an elastic element mounted therein;

a buffer device disposed in the compartment of the support ring and abutting with the elastic element of the pivoting device, with the buffer device including a driving element having a first end formed on an end thereof and receiving the elastic element and a second end opposite to the first end; and an adjusting element abutting with the second end of the driving element and including an elastic element mounted thereon, wherein the buffer device includes a pressed element having a first end abutting with the elastic element of the adjusting element and a second end formed thereon opposite to the first end and abutting with the driving element;

wherein the elasticity of the elastic element of the adjusting element is smaller than the elasticity of the elastic element of the pivoting device;

wherein while the cover is mounted on the support ring, the elastic element of the pivoting device is pressed and allows the driving element to be in a first position and the adjusting element to be released;

wherein while the driving element is in a second position, the pressed element is provided to press the adjusting element; when the cover is open, the elastic element of the pivoting device is released and the driving element is driven to press the elastic element of the adjusting element;

wherein part of the force from releasing the elastic element of the pivoting device provides to press the elastic element of the adjusting element so that the force to lift the cover is weakened and the speed of lifting the cover is retarded.

2. The cover assembly for a trash bin as claimed in claim 1, wherein the buffer device includes a tube allowing the adjusting element to be disposed therein and the driving element to be mounted on an end thereof;

wherein an interior surface of the tube corresponds to the adjusting element so that the adjusting element cannot be turned relative to the tube.

3. The cover assembly for a trash bin as claimed in claim 1, wherein the adjusting element includes a shaft formed on an end thereof and a pin formed on another end thereof; wherein the elastic element is disposed and a protrusion is defined on the tip of the pin toward the pressed element, with the first end of the pressed element forming a hole therein, with the hole receiving the protrusion.

4. The cover assembly for a trash bin as claimed in claim 1, wherein the driving element has a first end formed an end thereof, a second end formed on another end thereof and abutting with the second end of the pressed end and a hole defined in the interior of the first end of the driving element and adapted for receiving the elastic element of the pivoting device; wherein both the second end of the pressed element and the second end of the driving element are edge cam in section.

5. The cover assembly for a trash bin as claimed in claim 1, wherein the buffer device further includes a connecting element having a first end formed on an end thereof, a second end on another end thereof opposite to the first end and abutting with the adjusting element and a hole defined in the interior of the first end thereof, with the cover assembly further including two pivoting devices disposed in the compartment of the support ring and connected to the cover and the support ring, with each of the pivoting devices including an elastic element mounted therein;

wherein the two elastic elements of the two pivoting devices are respectively received in the first end of the driving element and the first end of the connecting element.

6. The cover assembly for trash bin as claimed in claim 1, wherein the compartment of the support ring includes an engaging hole formed on the interior side wall thereof and adapted for engaging with the pivoting device.

7. The cover assembly for a trash bin as claimed in claim 5, wherein the compartment of the support ring includes two engaging holes formed on the interior side wall thereof and opposite to each other;

wherein the engaging holes are respectively adapted for engaging with the two pivoting devices.

8. The cover assembly for a trash bin as claimed in claim 1, wherein the pivoting element includes a block having a through-hole defined therein, with a coupling element that is mounted in the through-hole having a engaging end protruding from the block and a recess formed in the interior therein and receiving the elastic element of the pivoting device.

9. The cover assembly for a trash bin as claimed in claim 5, wherein each of the two pivoting elements includes a block having a through-hole defined therein, with a coupling element that is mounted in the through-hole having a engaging end protruding from the block and a recess formed in the interior therein and receiving the elastic element of the pivoting device.

10. The cover assembly for a trash bin as claimed in claim 8, wherein the block of the pivoting device includes a screwed protrusion for engaging the cover, with the cover including a engaging element adapted to engage with the screwed protrusion of the pivoting device, with the engaging end of the coupling element provided for engaging with the compartment of the support ring.

11. The cover assembly for a trash bin as claimed in claim 9, wherein the block of each of the pivoting devices includes a screwed protrusion for engaging the cover, with the cover including a engaging element adapted to engage with the screwed protrusion of each of the pivoting devices, with the engaging end of each of the coupling element provided for engaging with the compartment of the support ring.

* * * * *